US010647474B2

(12) United States Patent
Rubinstein

(10) Patent No.: US 10,647,474 B2
(45) **Date of Patent: *May 12, 2020**

(54) AUTOMATICALLY CLOSING DISPENSER

(71) Applicant: URC Ltd, Herzlia (IL)

(72) Inventor: Ehud Rubinstein, Herzliya (IL)

(73) Assignee: URC Ltd, Herzlia (IL)

( * ) Notice: Subject to any disclaimer, the term of this patent is extended or adjusted under 35 U.S.C. 154(b) by 0 days.

This patent is subject to a terminal disclaimer.

(21) Appl. No.: 16/561,104

(22) Filed: Sep. 5, 2019

(65) Prior Publication Data

US 2019/0389623 A1 Dec. 26, 2019

Related U.S. Application Data

(63) Continuation of application No. 15/075,247, filed on Mar. 21, 2016, now Pat. No. 10,407,211.
(Continued)

(51) Int. Cl.
*B65D 25/00* (2006.01)
*B65D 25/28* (2006.01)
(Continued)

(52) U.S. Cl.
CPC ..... *B65D 25/005* (2013.01); *A47B 49/002* (2013.01); *A47F 1/02* (2013.01);
(Continued)

(58) Field of Classification Search
CPC .. B65D 25/005; B65D 25/20; B65D 25/2897; B65D 25/54; B65D 25/00; B65D 25/28;
(Continued)

(56) References Cited

U.S. PATENT DOCUMENTS 92,618 A 7/1869 Leonard
651,324 A 6/1900 Doremus
(Continued)

FOREIGN PATENT DOCUMENTS

CN 1036615 10/1989
CN 1195633 10/1998
(Continued)

OTHER PUBLICATIONS

Notification of Office Action and Search Report dated Sep. 25, 2019 From the State Intellectual Property Office of the People's Republic of China Re. Application No. 201780020143.0 and Its Translation of Office Action Into English. (12 Pages).
(Continued)

*Primary Examiner* — Jennifer E. Novosad

(57) ABSTRACT

A dispensing device, comprising a container, one or more support members mechanically coupled to one or more of the lateral walls, a base which has one or more supporting arms and a cover element mechanically coupled to one or more of the supporting arms to remain fixed while said container rotates around said rotation axis. The container includes a storage portion defined by a circumferential wall and two or more lateral walls with a dispensing opening defined in the circumferential wall. The supporting arm(s) support rotation of the container from a closed state to an open state and vice versa. The rotation is held around a rotation axis defined by a location of the support member(s). The cover element covers the dispensing opening when the container is rotated into the closed state and does not cover the dispensing opening when the container is rotated into the open state.

18 Claims, 15 Drawing Sheets

Related U.S. Application Data

(60) Provisional application No. 62/136,460, filed on Mar. 21, 2015.

(51) Int. Cl.

| | |
|---|---|
| ***B65D 25/54*** | (2006.01) |
| ***B65D 25/20*** | (2006.01) |
| ***A47B 49/00*** | (2006.01) |
| ***A47F 3/08*** | (2006.01) |
| ***A47F 5/03*** | (2006.01) |
| ***A47F 3/11*** | (2006.01) |
| ***A47F 1/02*** | (2006.01) |
| ***A47G 19/32*** | (2006.01) |

(52) U.S. Cl.

CPC ..... *A47F 3/08* (2013.01); *A47F 3/085* (2013.01); *A47F 3/11* (2013.01); *A47F 5/03* (2013.01); *A47G 19/32* (2013.01); *B65D 25/20* (2013.01); *B65D 25/2897* (2013.01); *B65D 25/54* (2013.01)

(58) Field of Classification Search

CPC .. A47F 1/02; A47F 5/03; A47F 5/0081; A47F 5/0093; A47F 5/02; A47F 1/04; A47F 1/06; A47F 2003/021; A47F 3/08; A47F 3/10; A47F 3/11; A47F 3/085; A47F 1/03; A47F 3/02; A47F 1/00; A47B 49/002; A47B 49/00; A47B 63/065; A47B 23/08; A47B 19/32; A47G 19/32

USPC ..... 211/164, 131.2, 163, 70, 78, 79, 59.2; 312/270.1, 270.3, 34.8, 34.19; 221/54, 221/188, 266, 268, 269, 277, 285, 306; 222/366–368, 558

See application file for complete search history.

(56) References Cited

U.S. PATENT DOCUMENTS

| | | | | |
|---|---|---|---|---|
| 730,512 | A | 6/1903 | Bever | |
| 796,579 | A | 8/1905 | Jessop | |
| 882,858 | A | 3/1908 | Alexander et al. | |
| 1,227,323 | A | 5/1917 | Russell | |
| 1,348,134 | A | 7/1920 | Barnstead | |
| 1,377,565 | A | 5/1921 | Dickerson | |
| 1,781,769 | A | 11/1930 | Stout et al. | |
| 1,841,926 | A | 1/1932 | Zuehl | |
| 1,867,145 | A | 7/1932 | Godfrey | |
| 1,883,776 | A | 10/1932 | Forsyth | |
| 1,970,128 | A | 8/1934 | Collins | |
| 2,138,190 | A | 11/1938 | Myers | |
| 2,188,660 | A | 1/1940 | Kettles, Jr. | |
| 2,439,697 | A | 4/1948 | Scott | |
| 2,447,253 | A | 8/1948 | Jonas | |
| 2,562,593 | A | 7/1951 | Adams | |
| 2,604,372 | A | 7/1952 | Klinglesmith | |
| 2,665,517 | A | 1/1954 | Archer | |
| 2,814,152 | A | 11/1957 | Trujillo | |
| 2,919,051 | A | 12/1959 | Wideburg et al. | |
| 2,981,417 | A | 4/1961 | Cross | |
| 3,980,116 | A | 9/1976 | Edwards | |
| 4,047,637 | A | 9/1977 | Grunstad et al. | |
| 4,084,676 | A | 4/1978 | Motyka et al. | |
| 4,320,849 | A | 3/1982 | Yellin | |
| 4,563,834 | A | 1/1986 | Spencer | |
| 4,616,891 | A | 10/1986 | Jantzen | |
| 4,658,984 | A | 4/1987 | Brunner | |
| 4,892,367 | A | 1/1990 | Jantzen | |
| 5,039,180 | A | 8/1991 | Lemons | |
| 5,385,266 | A | 1/1995 | Pate | |
| 5,799,787 | A | 9/1998 | Talbot | |
| 5,934,010 | A | 8/1999 | Blackburn | |
| 6,056,132 | A | 5/2000 | Becker et al. | |
| 6,056,233 | A | 5/2000 | Von Schenk | |
| 6,084,210 | A | 7/2000 | Glucksman | |
| 6,134,825 | A | 10/2000 | Moffett et al. | |
| 6,390,298 | B1 | 5/2002 | Garro | |
| D488,643 | S | 4/2004 | Birmingham | |
| 6,783,033 | B1 | 8/2004 | Chan | |
| D532,995 | S | 12/2006 | Dorazio | |
| D543,842 | S | 6/2007 | Jackson | |
| 7,699,181 | B2 | 4/2010 | Torro | |
| 7,730,663 | B2 | 6/2010 | Souvlos et al. | |
| 7,980,399 | B2 | 7/2011 | Colin | |
| D676,685 | S | 2/2013 | Dobelbower | |
| 8,950,599 | B2 | 2/2015 | Wilder | |
| 8,955,699 | B2 | 2/2015 | Wilder | |
| 9,010,823 | B1 | 4/2015 | Murray | |
| 9,095,210 | B1 | 8/2015 | Alspaugh | |
| 9,182,195 | B2 | 11/2015 | Hogue | |
| 9,578,992 | B2 | 2/2017 | Knowlton | |
| 10,407,211 | B2 * | 9/2019 | Rubinstein | B65D 25/54 |
| 2002/0040880 | A1 | 4/2002 | Vasudeva | |
| 2004/0194635 | A1 | 10/2004 | Xu | |
| 2005/0194336 | A1 | 9/2005 | Wu | |
| 2007/0267432 | A1 | 11/2007 | Woods et al. | |
| 2009/0120939 | A1 | 5/2009 | Wang er al. | |
| 2009/0236953 | A1 | 9/2009 | Cardozo Martinez | |
| 2010/0102101 | A1 | 4/2010 | Keily et al. | |
| 2016/0135652 | A1 | 5/2016 | Cittadino et al. | |
| 2016/0272370 | A1 | 9/2016 | Rubinstein | |
| 2019/0389623 | A1 * | 12/2019 | Rubinstein | B65D 25/20 |

FOREIGN PATENT DOCUMENTS

| | | |
|---|---|---|
| CN | 1555236 | 12/2004 |
| CN | 101318581 | 12/2008 |
| CN | 202863977 | 4/2013 |
| EP | 0331940 | 9/1989 |
| GB | 2323523 | 9/1998 |
| GB | 23590604 | 12/2000 |
| JP | 2013-091512 | 5/2013 |
| WO | WO 03/015587 | 2/2003 |
| WO | WO 2008/012382 | 1/2008 |
| WO | WO 2017/163239 | 9/2017 |

OTHER PUBLICATIONS

Ex Parte Quayle OA Dated Feb. 8, 2019 From the US Patent and Trademark Office Re. U.S. Appl. No. 15/075,247. (17 pages).

International Preliminary Report on Patentability dated Oct. 4, 2018 From the International Bureau of WIPO Re. Application No. PCT/IL2017/050351. (8 Pages).

International Search Report and the Written Opinion dated Jun. 28, 2017 From the International Searching Authority Re. Application No. PCT/IL2017/050351. (16 Pages).

Notice of Allowance dated May 3, 2019 From the US Patent and Trademark Office Re. U.S. Appl. No. 15/075,247. (3 pages).

Notification of Office Action and Search Report dated Jun. 14, 2019 From the State Intellectual Property Office of the People's Republic of China Re. Application No. 201780020143.0. (6 Pages).

Restriction Official Action dated Dec. 5, 2018 From the US Patent and Trademark Office Re. U.S. Appl. No. 15/075,247. (5 pages).

Translation of Notification dated Jun. 25, 2019 From OA dated Jun. 14, 2019 From the State Intellectual Property Office of the People's Republic of China Re. Application No. 201780020143.0. (1 Page).

* cited by examiner

AUTOMATICALLY CLOSING DISPENSER

RELATED APPLICATIONS

This application is a continuation of U.S. patent application Ser. No. 15/075,247 filed on Mar. 21, 2016, which claims the benefit of priority under 35 USC 119(e) of U.S. Provisional Patent Application No. 62/136,460 filed on Mar. 21, 2015 and titled "AUTOMATICALLY CLOSING CONTAINER", the contents of which are incorporated herein by reference in their entirety.

FIELD AND BACKGROUND OF THE INVENTION

The present invention, in some embodiments thereof, relates to a self-closing dispenser and, more particularly, but not exclusively, to an automatically closing dispenser for dispensing food and non-food substances.

Containers in general and dispensers in particular are widely used to store solid granular food and/or non-food substances such as for example, cookies, candy, serial, pop-corn, rice, sugar, coffee, tea bags, cotton balls, cotton swabs and the likes. The containers and/or dispensers may be used at home as well as at public places such as, for example, restaurants, hotels, hospitals and the likes.

The containers and/or dispensers aim to provide means for organized and/or orderly storage where the food and/or non-food substances may be properly contained and available for use. In addition, especially when food substances are concerned the containers and/or dispensers may provide a sealed storage environment to protect the stored food substance, for example, avoid from becoming stale, avoid exposure to humidity and/or avoid pest access.

The dispensers may further allow ease of use to allow users to easily access the stored substance(s).

SUMMARY OF THE INVENTION

According to some embodiments of the present invention there is provided a dispensing device, comprising:

A container which includes a storage portion defined by a circumferential wall two or more lateral walls, the circumferential wall has a dispensing opening defined in the circumferential wall.

One or more support member mechanically coupled to one or more of the two or more lateral walls of the container.

A base having one or more supporting arms used for anchorage of the one or more support members for supporting a rotation of the container from a closed state to an open state and vice versa. The rotation is held around a rotation axis defined by a location of the one or more support members.

A cover element mechanically coupled to the one or more supporting arms to remain fixed while the container rotates around the rotation axis.

The cover element covers the dispensing opening when the container is rotated into the closed state and does not cover the dispensing opening when the container is rotated into the open state.

Optionally, the one or more support members are mechanically integrated in the container.

The container includes a handle located at the bottom of the dispensing opening to allow a user to rotate the container.

The rotation axis passes through a center of mass of the container.

Optionally, the dispensing device comprises a weight element mechanically coupled to the container at an offset from the rotation axis so as to induce the rotation of the container from the open state to the closed state by Gravity-induced torque.

Optionally, the container is elongated to one side away from the rotation axis in a direction opposite of the dispensing opening to shift a center of mass of the container away from the rotation axis so as to induce the rotation of the container from the open state to the closed state by Gravity-induced torque.

Optionally, the rotation axis is offset from a center of mass of the container so as to induce the rotation of the container from the open state to the closed state by Gravity-induced torque.

Optionally, the dispensing device comprises a spring element mechanically coupled to the container and the base so as to induce the rotation of the container from the open state to the closed state by spring-induced torque.

Optionally, the dispensing device comprises an elastic band element mechanically coupled to the container and the base so as to induce the rotation of the container from the open state to the closed state by elasticity-induced torque.

Optionally, the dispensing device comprises a first magnet element mechanically coupled to the container; the first magnet element maintains a magnetic relation with a second magnet element mechanically coupled to the base so as to induce the rotation of the container from the open state to the closed state by magnet-induced torque. The magnetic relation includes attraction and/or repulsion.

Optionally, the dispensing device comprises a motor mechanically coupled to the one or more supporting arms so as to induce the rotation of the container from the open state to the closed state by operation of the motor.

Optionally, the one or more support members include a stoppage element which is barred by the one or more supporting arms at a rotation span limit of the rotation.

The cover element is loosely supported in a plurality of notches each formed in one of the one or more supporting arms. The cover element is pushed in the plurality of notches toward the container by a force induced by the rotation of the container from the open state to the closed state.

Optionally, the container has a frame area outlining the dispensing opening such that the cover element overlaps with the frame area in the closed state.

Optionally, the cover element includes an elastic element which makes contact with the container around the dispensing opening in the closed state.

Optionally, the cover element is curved.

Optionally, the circumferential wall is curved.

Optionally, the one or more lateral walls are disc shaped.

Optionally, the circumferential wall and the at least two lateral walls are transparent.

Optionally, the container is detachable from the one or more supporting arms.

Optionally, the cover element is detachable from the one or more supporting arms.

According to some embodiments of the present invention there are provided methods of composing and/or assembling a dispensing device, comprising:

Providing:

A container which includes a storage portion defined by a circumferential wall having a dispensing opening defined in the circumferential wall.

One or more support members mechanically coupled to one or more lateral walls of the container.

A base having one or more supporting arms.

A cover element.

Placing the one or more support member in a mechanical connection with the one or more supporting arms for supporting a rotation of the container from a closed state to an open state and vice versa. The rotation is held around a rotation axis defined by a location of the one or more support members.

Coupling the cover element to the one or more supporting arm to remain fixed while the container rotates around the rotation axis. The cover element covers the dispensing opening when the container is rotated into the closed state and does not cover the dispensing opening when the container is rotated into the open state.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1A:
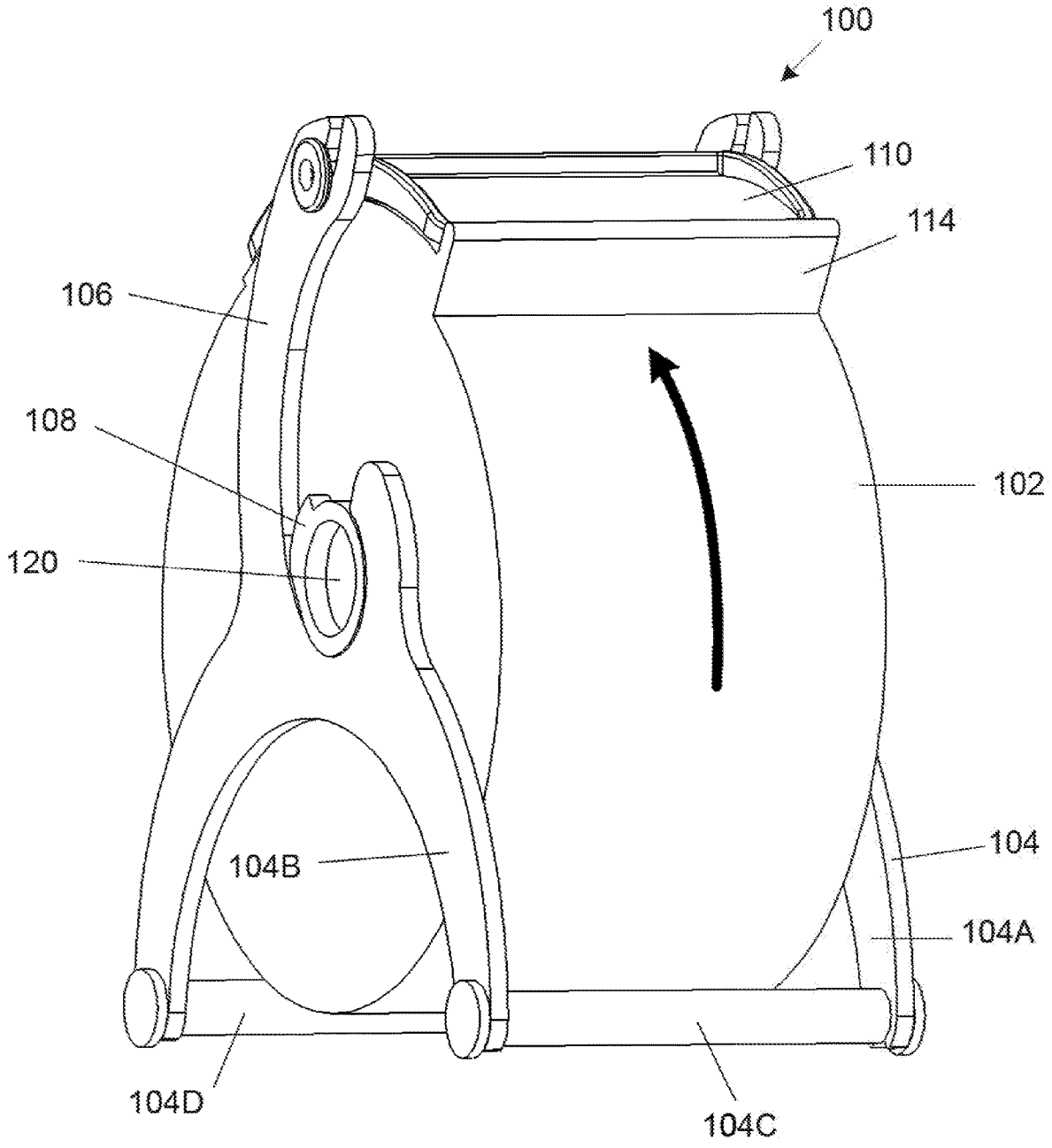
FIG. 1A is a schematic illustration of a perspective front view of an exemplary self-closing dispenser in a closed state, according to an exemplary embodiment of the present invention.

The present invention, in some embodiments thereof, relates to a self-closing dispenser and, more particularly, but not exclusively, to an automatically closing dispenser for dispensing food and non-food substances.

According to some embodiments of the present invention there are provided a dispenser and assembly methods for the dispenser. The dispenser which is a self-closing dispenser includes a rotating container mounted on a base having one or more supporting arms which are mechanically coupled to the container to allow rotational movement of the container from an open state to a closed state and vice versa. The rotation movement is held around a rotation axis located at the point of anchorage where the container is mounted on the supporting arm(s) of the base. The container includes a storage space for storing solid granular food and/or non-food substances such as for example, cookies, candy, serial, pop-corn, rice, sugar, coffee, tea bags, cotton balls, cotton swabs and the likes. The container also includes a dispensing opening defined in the container's circumferential wall.

The dispensing opening is covered by a cover (lid) element which is attached to the supporting arm(s) when the container is rotated to the closed state. When a user rotates the container to the open state, the dispensing opening becomes exposed allowing the user to access the substance stored inside the container for both filling the container with the stored substance as well as retrieving the stored substance from the container. The dispenser further includes a mechanism for inducing the rotation movement from the open state to the closed state, for example, a weight, a spring, a rubber band, a magnet, a motor and the likes. Optionally, the container is mechanically designed to have its center of mass away from the rotation axis such that the weight of the container itself induces the rotation from the open state to the closed state.

The dispenser may further include one or more stoppage elements which limit the rotation to the open state and/or the closed state such that the dispensing opening conveniently faces the user and/or avoiding spillage of the stored substance when the container is rotated to a degree where the dispensing opening is facing downward.

Optionally, the container includes a handle at the lower side of the dispensing opening (i.e. away from the cover element) to allow the user to easily rotate the container to the open state for accessing the stored substance.

The cover element may be loosely coupled to the supporting arm(s), for example, through one or more notches in order to overcome mechanical mating tolerances and properly fit the dispensing opening. The rotation force of the container during its rotation to the closed state may be used to adjust the cover element in its designated position and/or location such that it properly covers the dispensing opening. The container may include a designated frame outlining the dispensing opening such that in the closed state, the cover element overlaps the frame to improve sealing of the container. The cover element may further include an elastic element around it to further improve the sealing of the container.

The dispenser by its innovative design and construction may present several significant advantages over existing solutions. The dispenser container may be firmly placed on a surface such as, for example, a table, a counter and/or a shelf exempting the user from holding, moving and/or handling the container for accessing the stored substance. The dispenser may be easily operated by the user who may bring the container to the open state by gently pushing the container handle downwards thus brining the dispensing opening to be directly in front of the user. The user also is relieved from closing the dispenser as the dispenser automatically rotates to the closed state once the container handle is released by the user. Moreover once rotated to the open state the solid granular stored substance may flow in the direction of the dispensing opening making access to the stored substance simpler and/or easier. The dispenser may be single handedly operated, i.e. a single hand may be used for both rotating the container to the open state and for retrieving the stored substance from the container.

Furthermore, the dispenser may exhibit improved sealing performance which is particularly beneficial for stored food substances which may be better protected from, for example, becoming stale, exposure to humidity and/or exposure to pests.

Optionally, the container and/or the cover of the dispenser may be easily detached from the base and/or the supporting arm(s). Detaching the container and/or the cover may allow for simple and/or easy maintenance, for example, cleaning and/or washing. Moreover, removing the cover may allow the user to more easily fill the container of the dispenser with the stored substance when the container is placed in the closed state with the dispensing opening facing upwards as opposed to filling the container when in the open state with the dispensing opening facing forwards. When in the closed state the container is static and the stored substance may be easily applied into the container while when in the open state, the container needs to be held in place by the user to overcome the rotation mechanism trying to bring the container to the closed state.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

A preferred embodiment self-closing dispenser is described hereinafter, however the preferred embodiment should not be construed as limiting since multiple other implementations which employ the same concepts described throughout the present invention are possible.

Figure 1B:
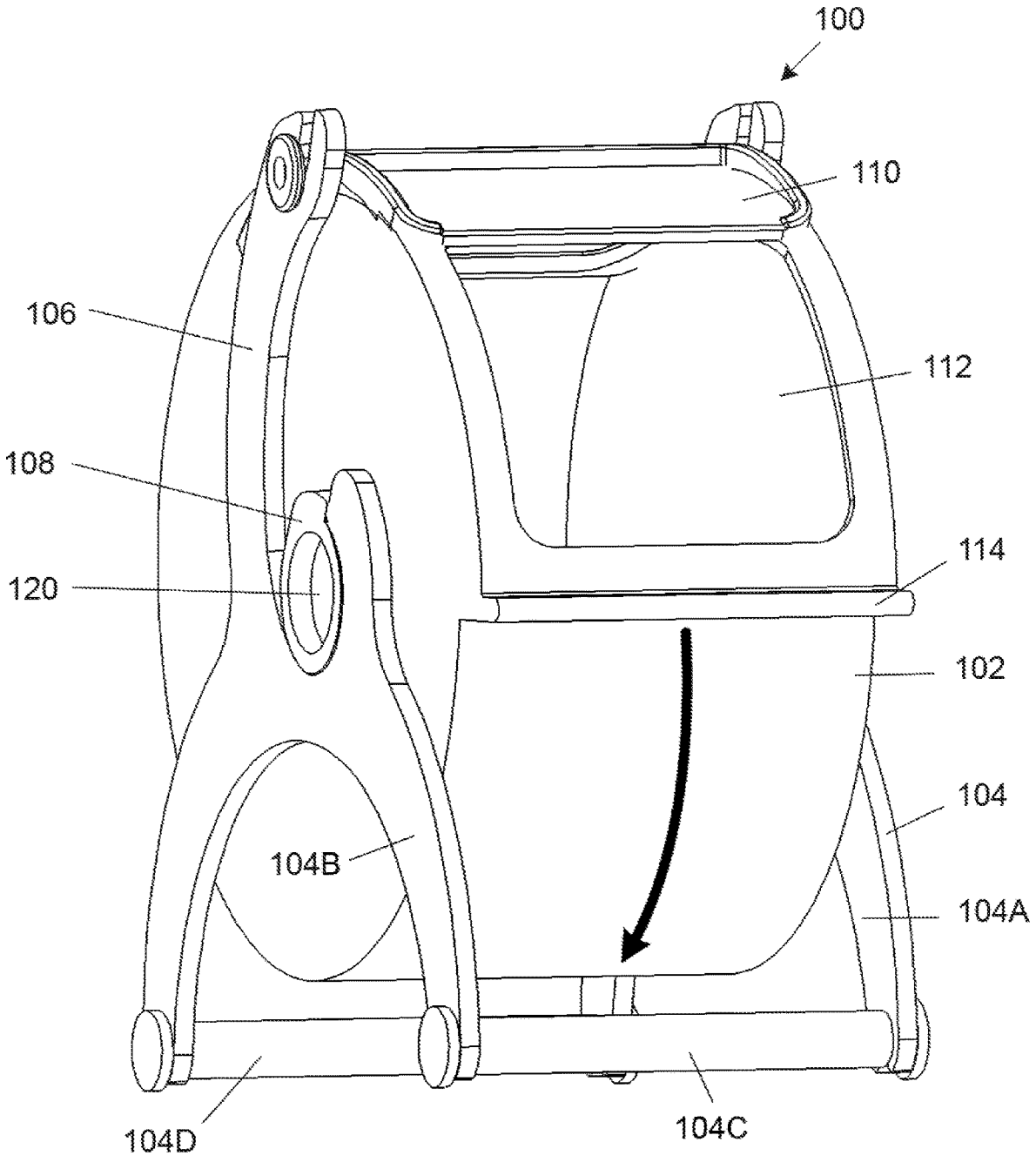
FIG. 1B is a schematic illustration of a perspective front view of an exemplary self-closing dispenser in an open state, according to an exemplary embodiment of the present invention.

Reference is now made to FIG. 1A which is a schematic illustration of a perspective front view of an exemplary dispenser in a closed state and to FIG. 1B which is a schematic illustration of a perspective front view of an exemplary dispenser in an open state, according to an exemplary embodiment of the present invention. A self-closing dispenser 100 includes container 102 mounted on a base 104 through two support members 108 (one on each of the two lateral walls of the container 102) which are mechanically anchored to respective one of two supporting arms 106 of the base 104. The dispenser 100 further includes a cover element 110 which is coupled to one or more of the supporting arms 106.

Optionally, the dispenser 100 is constructed with a base having a single supporting arm 106 having a mechanical connection for anchoring a single support member 108 which is coupled to the container 102. However for brevity, the presented embodiment having two supporting arms 106 anchoring respective two support members 108 is discussed and described.

The parts of the dispenser 100 such as the container 102, the base 104, the supporting arms 106, the support members 108 and/or the cover 110 may be constructed of one or more of a plurality of materials, for example, polycarbonate (PC), polyethylene (PE), acrylonitrile butadiene styrene (ABS) and the likes.

Additional materials, for example, glass, aluminum, wood and/or stone may be used for one or more of the parts of the dispenser 100. Two or more of the construction materials may be combined for producing one or more of the parts of the dispenser 100.

One or more of the parts of the dispenser 100 may be solid, transparent and/or semi-transparent. For example, the container 102 may be transparent to provide visibility to the stored substance. Other parts of the dispenser 100, for example, the supporting arms 106 may be transparent and/or semi-transparent for decorative and/or aesthetic reasons. The parts of the dispenser 100 may be formed with one or more surface textures.

The container 102 is constructed of a circumferential wall and two lateral walls forming a storage space for storing solid granular food and/or non-food substances such as for example, cookies, candy, serial, pop-corn, rice, sugar, coffee, tea bags, cotton balls, cotton swabs and the likes. A dispensing opening 112 is defined in the circumferential wall of the container 102 to allow a user to access the stored substance.

Optionally, the container 102 has a curved and/or circular circumferential wall and disk shaped lateral walls. However the container 102 may be formed in other shapes of the circumferential wall and the lateral walls.

The two support members 108 are coupled to the container 102 by means of mechanical connection, for example, screws and/or molded clips and/or rails which lock the support members 108 in place. Optionally, the support members 108 are integrated with the container 102 such that they constitute a single part produced using, for example, molding, three dimensional (3D) printing and/or computer numerical control (CNC) machining.

Optionally, the base 104 comprises two or more parts which are joined together by one or more mechanical joining elements. As shown for the dispenser 100, the base 104 comprises two similar parts 104A and 104B which are joined together with two mechanical joining elements 104C and 104D. However for brevity, the base 104 is referred to as a single part which is either a single integrated part and/or pre-assembled. The supporting arms 106 extending from the base 104 may be coupled to the base 104 by means of mechanical connection, for example, screws, molded clips and/or molded rails which lock the support members 108 in place.

Optionally, the supporting arms 106 are integrated with the base 104 such that they constitute a single part produced using, for example, molding, 3D printing and/or CNC machining.

The container 102 is mounted on the base 104 by anchoring the support members 108 in the supporting arms 106 at one or more mechanical connection points. The support members 108 are anchored in the support arms 106 to allow a rotational movement of the container 102 from a closed state to an open state and vice versa around a rotation axis defined by the (center of the) support members 108. The rotation axis may be defined as the center of mass of the container 102. The support members 108 may be anchored to the support arms 106 and/or the base 104 using, for example, one or more notches adapted to loosely fit the support members 108 such that the rotational movement of the container 102 is not hindered due to a tight connection between the support members 108 and the supporting arms 106. Optionally and/or alternatively bearing(s) may be used to attach the support members 108 to the support arms 106 for supporting the rotational movement of the container 102. The container 102 may be anchored to the support arms 106 and/or the base 104 such that it may allow detaching the container 102 from the dispenser 100 for maintenance purposes, for example, cleaning, washing and/or filling the container 102 with the stored substance.

In some exemplary embodiments, the cover element 110 is loosely coupled to one or more of the supporting arms 106 such that the cover is substantially static with a certain degree of freedom of movement. The cover 110 may be loosely coupled to the supporting arms 106 through one or more notches formed in the supporting arms 106 to host and/or guide the cover 110 to properly fit over the dispensing opening 112 of the container 102 in the closed state. Optionally, a frame area outlines the dispensing opening 112 such that in the closed state the cover 110 overlaps with the frame area to improve sealing properties of the dispenser 100. The cover 110 may also include an elastic element, such as, for example, rubber placed around and/or at the bottom of the cover 110 to improve sealing of the container 102 in the closed state.

Optionally, the cover 110 has a curved shape. However the cover 110 may be formed in other shapes to fit the dispensing opening 112.

In the closed state, the container 102 is positioned such that the dispensing opening 112 is covered by the cover 110. The closed state is the idle state, i.e. when no external force(s) are applied to the dispenser 100 it is in the closed state.

The container 102 may include a handle 114 which allows a user to rotate the container 102 to the open state by applying downward pressure on the handle 114. In the open state, the dispensing opening 112 in the container 102 is exposed to allow access to the stored substance. The user may apply downward pressure on the handle 114 to rotate the container 102 to the open state. Once the user releases the handle 114 the container 102 is automatically rotated back to the closed state. The kinetic force of the rotational movement of the container 102 after released by the user may be used for guiding the cover 110 into its designated place such that the cover 110 properly covers the dispensing opening 112. For example, the handle 114 which is moving together with the container 102 may first meet the cover 110 which is loosely coupled to the supporting arms 106 and may direct the cover 110 to the appropriate location over the dispensing opening 112. The dispenser 100 may include one or more stoppage elements which limit the rotation movement of the container 102. to the open state and/or the closed state such that the dispensing opening conveniently faces the user and/or avoiding spillage of the stored substance when the container is rotated to a degree where the dispensing opening is facing downward.

The dispenser 100 may include one or more stoppage elements which limit the rotational movement of the container 102 in the open state and/or in the closed state. For example, the support member 108 may be constructed to include one or more protrusions which are barred by the supporting arm 106 such that the container 102 may not be further rotated in the open state. The protrusion may be located to allow sufficient rotation of the container 102 in the open state such that the dispensing opening 112 is fully exposed. Similarly. The same protrusions and/or other stoppage elements may be formed, for example, in the support member(s) 108 which limit the rotation movement of the container 102 in the closed state. While the cover 110 may block the rotational movement of the container 102 it may also be desired to limit the rotational movement of the container 102 when the cover 102 is not present (detached from the dispenser 100), for example, during filling of the container 102 with the stored substance.

The dispenser 100 includes a rotation mechanism for inducing the rotational movement for holding the container 102 in the closed state during idle time and/or for rotating the container 102 from the open state to the closed state after released by the user. In some exemplary embodiments, the rotation mechanism is a mechanical mechanism, for example, a weight, a spring and/or a rubber band. In other exemplary embodiments, the rotation mechanism may be a magnetic mechanism, for example, a pair of magnets. In yet other exemplary embodiments, the rotation mechanism may include a motor for inducing the rotational movement of the container 102.

Figure 2A:
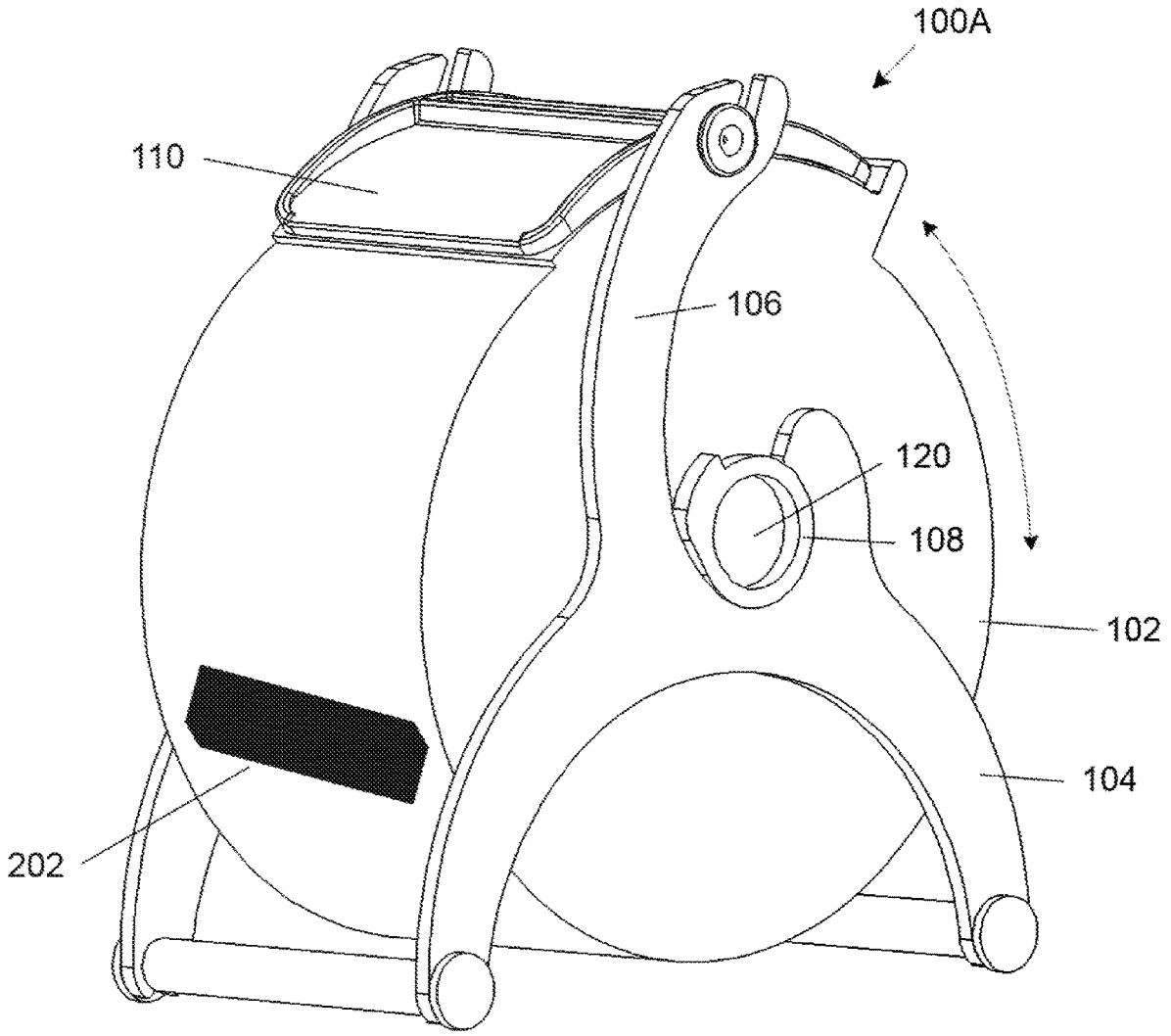
FIG. 2A is a schematic illustration of a perspective rear view of an exemplary self-closing dispenser comprising a weight to induce rotation of a container of the dispenser using gravity-induced torque, according to an exemplary embodiment of the present invention.

Reference is now made to FIG. 2A which is a schematic illustration of a perspective rear view of an exemplary self-closing dispenser comprising a weight to induce rotation of a container of the dispenser using gravity-induced torque, according to an exemplary embodiment of the present invention. An exemplary self-closing dispenser 100A such as the dispenser 100 presented in the closed state includes a weight 202. The weight 202 may be mechanically integrated with the container 102, for example, as a single molded part. The weight may also be a separate part which is mechanically coupled to the container 102, for example, by placing it in a compartment of the container 102 and/or attaching it to the container 102 through, for example, molded clips, molded rails and/or screws which secure the weight 202 in place. The weight 202 is coupled to the container 102 at an offset from the rotation axis 120 in the opposite direction from the dispensing opening 112 such that when in the open state, the gravity induced torque (force) is applied on the weight 202 to bring the container 102 back to the closed state. The weight of the weight 202 may be selected such that the gravity induced torque is sufficient for bringing the container 102 (including the stored substance) to the closed state while the gravity induced torque does not present difficulty for the user to rotate the container 102 to the open state.

In some exemplary embodiment the gravity induced torque may be used for automatically rotating the container 102 to the closed state by applying one or more constructions and/or designs of dispenser 100 without a need for the weight 202. In such designs and/or construction the center of mass of the container 102 may be shifted from the rotation axis 120. For example, the container 102 may be elongated in the opposite direction from the dispensing opening 112 as for example, an ellipsoid. The center of mass of the container 102 may also be shifted by placing additional material (which forms the container 102) at the side opposite the dispensing opening 112. As another example, the anchorage point of the support member(s) 108, and the supporting arm(s) 106 and/or the base 104 may be shifted towards the direction of the dispensing opening 112 such that the center of mass of the container 102 is shifted away from the rotation axis 120 in the opposite direction from the dispensing opening 112. Any one or more and/or a combination of two or more of the above designs and/or constructions may be applied to the dispenser 100.

Figure 2B:
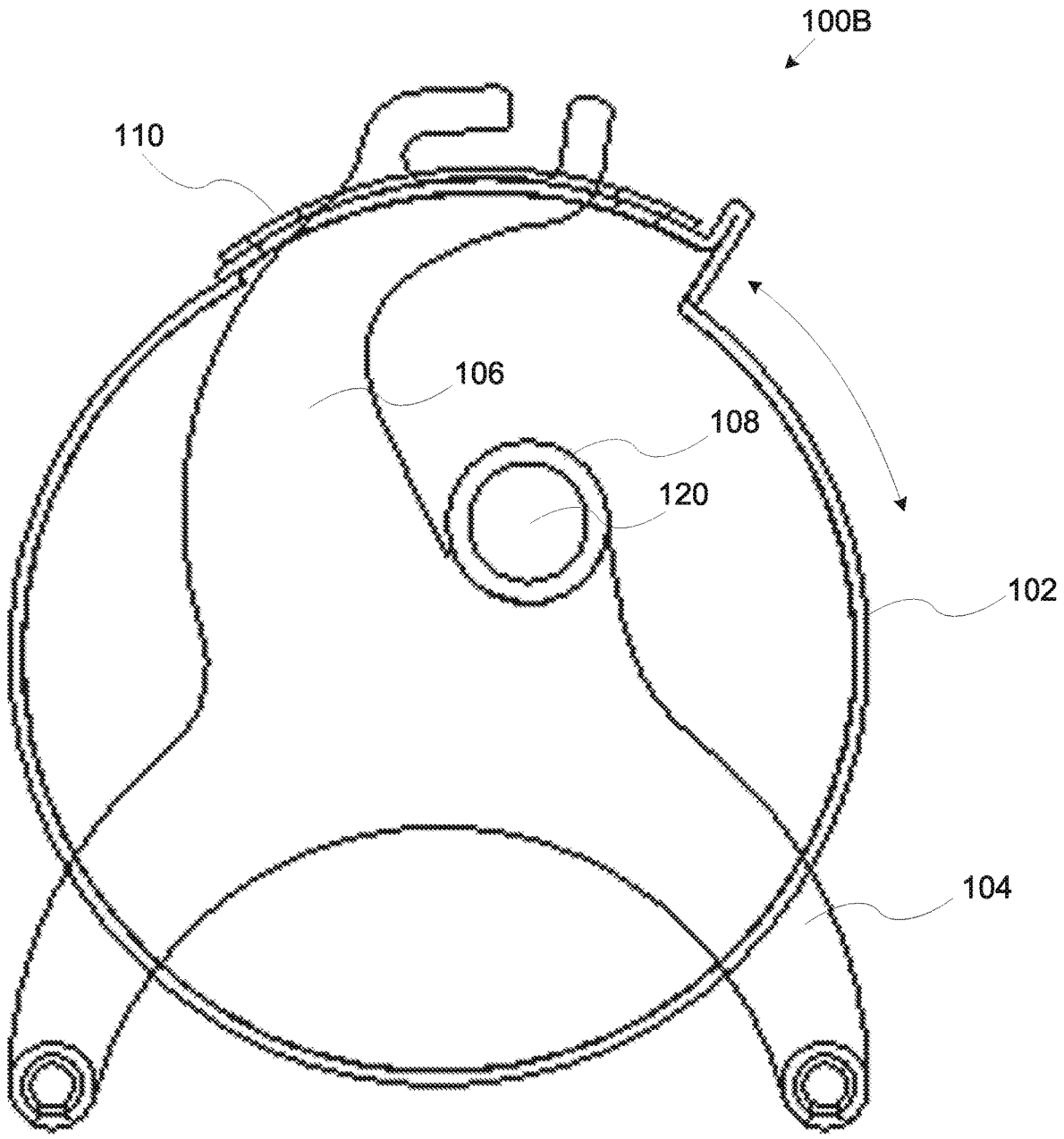
FIG. 2B is a schematic illustration of a side view of an exemplary self-closing dispenser having a rotation axis shifted from a center of mass of a container of the dispenser, according to an exemplary embodiment of the present invention.

Reference is now made to FIG. 2B which is a schematic illustration of a side view of an exemplary self-closing dispenser having a rotation axis shifted from a center of mass of a container of the dispenser, according to an exemplary embodiment of the present invention. An exemplary self-closing dispenser 100B such as the dispenser 100 presented in the closed state is designed and/or constructed to have a rotation axis such as the rotation axis 120 shifted from a center of mass of a container such as the container 102. An anchorage point in which one or more support members such as the support members 108 is shifted towards a dispensing opening such as the dispensing opening 112 defined in the circumferential wall of the container 102. By shifting the anchorage connection point the rotation axis 120 is also moved towards the dispensing opening 112 and the center of mass of the container is no longer located at the rotation axis 120. As result the gravity induced torque applied on the container 102 tends to rotate the container to the closed state for both holding the container 102 in the closed state during idle time and for rotating the container 102 from the open state back to the closed state.

Figure 2C:
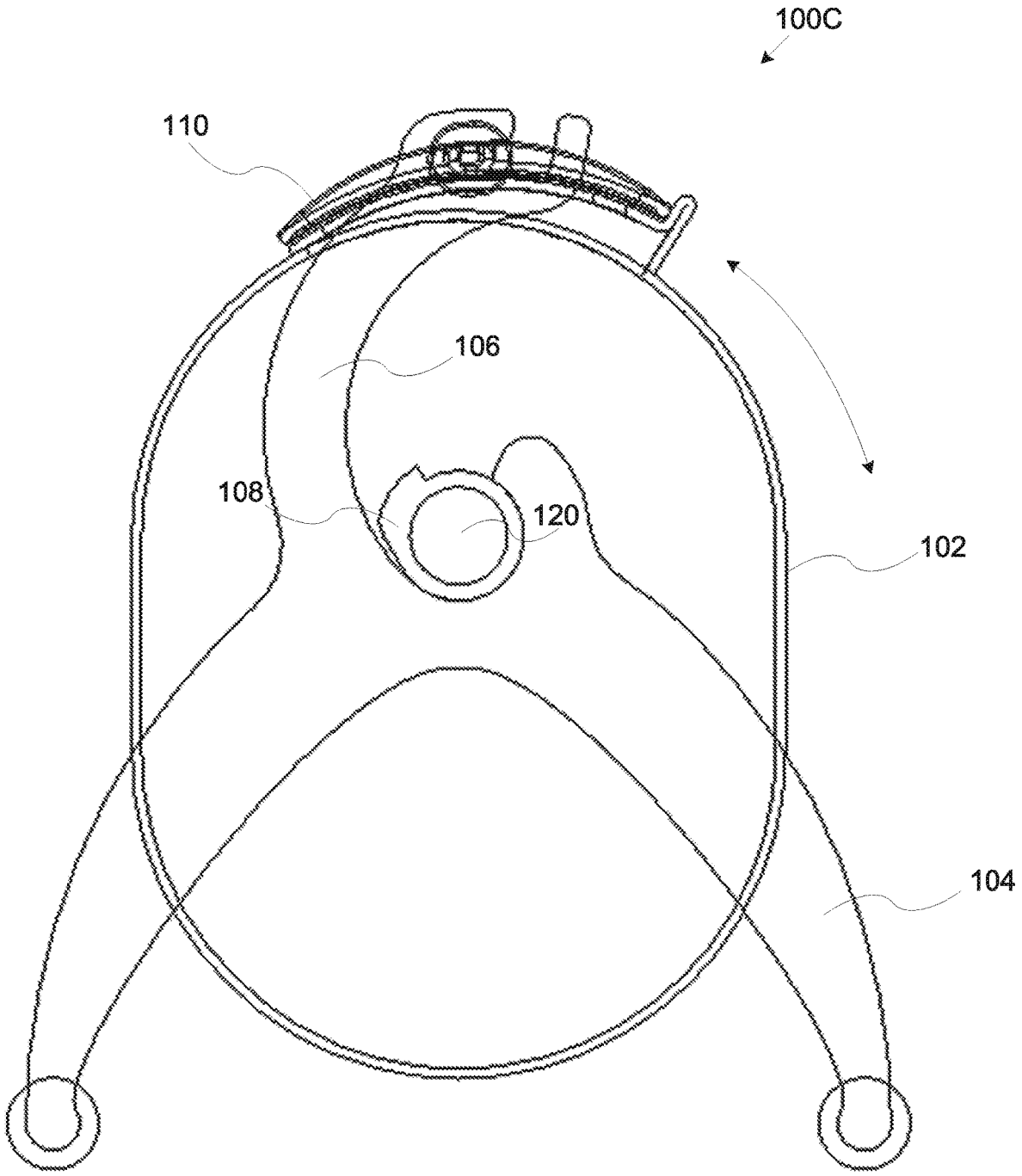
FIG. 2C is a schematic illustration of a side view of an exemplary self-closing dispenser having an elongated container, according to an exemplary embodiment of the present invention.

Reference is now made to FIG. 2C which is a schematic illustration of a side view of an exemplary self-closing dispenser having an elongated container, according to an exemplary embodiment of the present invention. An exemplary self-closing dispenser 100C such as the dispenser 100 presented in the closed state is designed and/or constructed to have an elongated container such as the container 102. The elongated structure of the container 102 implies that when in the open state, the center of mass of the container 102 is located in the opposite direction from a dispensing opening such as the dispensing opening 112 defined in the circumferential wall of the container 102. As result the gravity induced torque applied on the container 102 tends to rotate the container to the closed state for both holding the container 102 in the closed state during idle time and for rotating the container 102 from the open state back to the closed state.

Figure 2D:
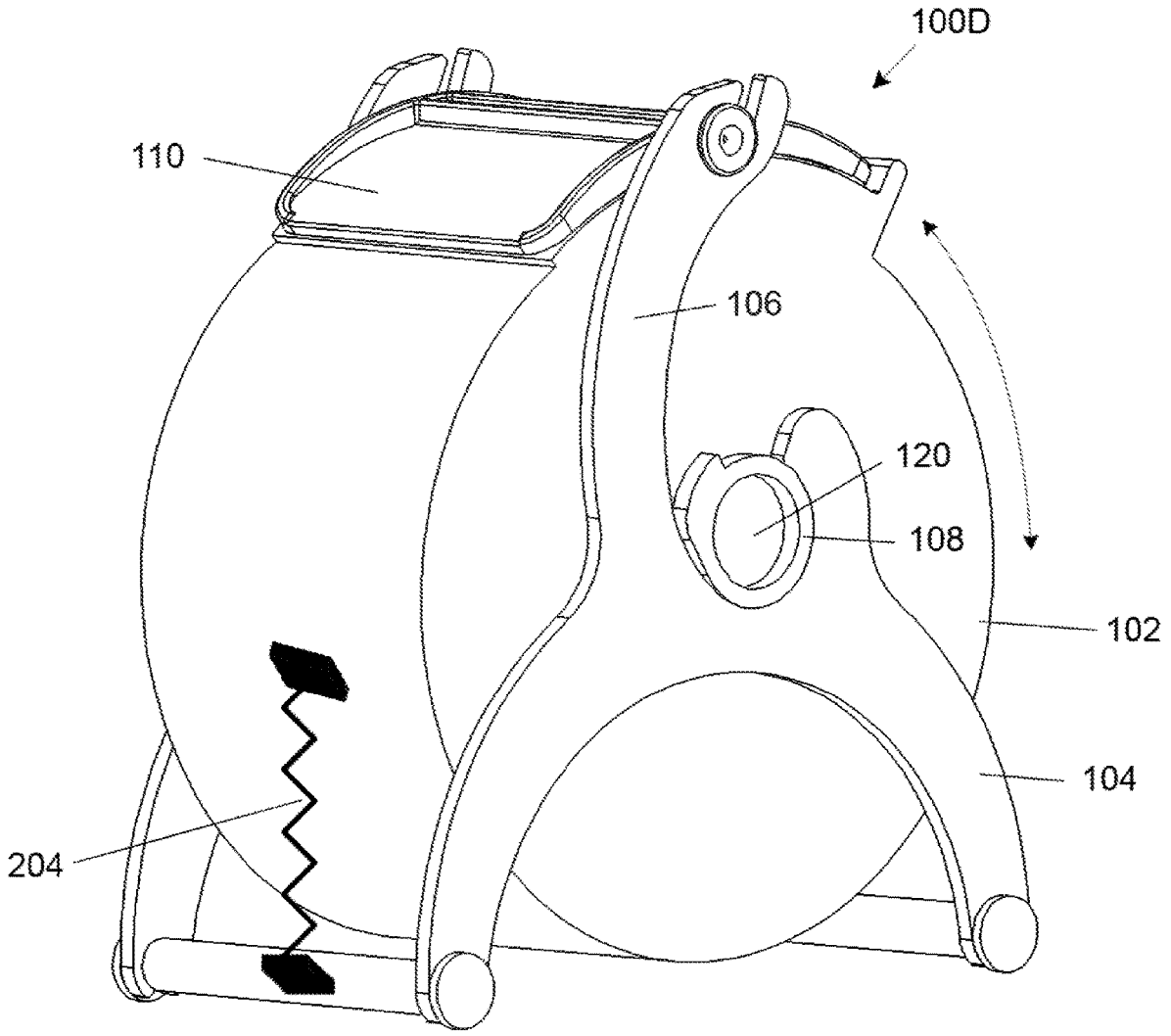
FIG. 2D is a schematic illustration of a perspective rear view of an exemplary self-closing dispenser comprising a spring to induce rotation of a container of the dispenser using spring compression induced torque, according to an exemplary embodiment of the present invention.

Reference is now made to FIG. 2D which is a schematic illustration of a perspective rear view of an exemplary self-closing dispenser comprising a spring to induce rotation of a container of the dispenser using spring compression induced torque, according to an exemplary embodiment of the present invention. An exemplary self-closing dispenser 100D such as the dispenser 100 presented in the closed state includes a spring 204, for example, a coil spring. The spring 204 may be coupled to the container 102 at one end and to the base 104 and/or to the supporting arm(s) 106 at the other end. The coupling may be done, for example, through hooks applied on the spring 204 which are inserted in molded rings in the container 102 and/or the base 104 and/or to the supporting arm(s) 106. The spring 204 is coupled to the container 102 and the base 104 (and/or the supporting arm 106) at the opposite direction from a dispensing opening such as the dispensing opening 112 such that when in the open state, the contraction induced torque (force) of the spring 204 brings the container 102 back to the closed state. The spring 204 may be selected to have a contraction factor which is sufficient for bringing the container 102 (including the stored substance) to the closed state while not presenting difficulty for the user to rotate the container 102 to the open state.

Figure 2E:
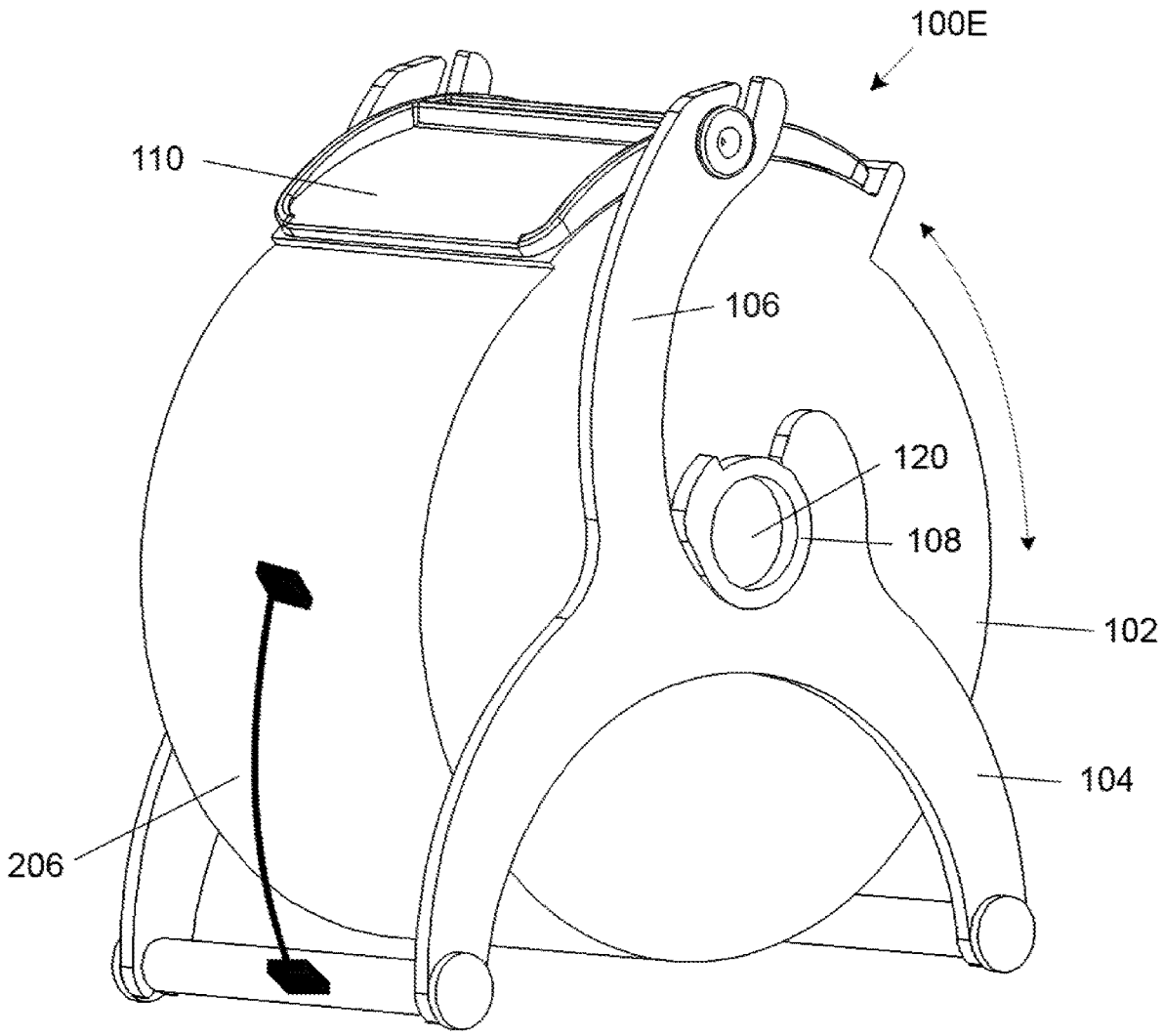
FIG. 2E is a schematic illustration of a perspective rear view of an exemplary self-closing dispenser comprising a rubber band to induce rotation of a container of the dispenser using elasticity induced torque, according to an exemplary embodiment of the present invention.

Reference is now made to FIG. 2E which is a schematic illustration of a perspective rear view of an exemplary self-closing dispenser comprising a rubber band to induce rotation of a container of the dispenser using elasticity induced torque, according to an exemplary embodiment of the present invention. An exemplary self-closing dispenser 100E such as the dispenser 100 presented in the closed state includes an elastic band 206, for example, a rubber band. The elastic band 206 may be coupled to the container 102 at one end and to the base 104 and/or to the supporting arm(s) 106 at the other end. The coupling may be done, for example, through hooks applied on the elastic band 206 which are inserted in molded rings in the container 102 and/or the base 104 and/or to the supporting arm(s) 106. The spring 204 is coupled to the container 102 and the base 104 (and/or the supporting arm 106) at the opposite direction from a dispensing opening such as the dispensing opening 112 such that when in the open state, the contraction induced torque (force) of the elastic band 206 brings the container 102 back to the closed state.

The elastic band 206 may be selected to have a contraction factor which is sufficient for bringing the container 102

(including the stored substance) to the closed state while not presenting difficulty for the user to rotate the container 102 to the open state.

Figure 2F:
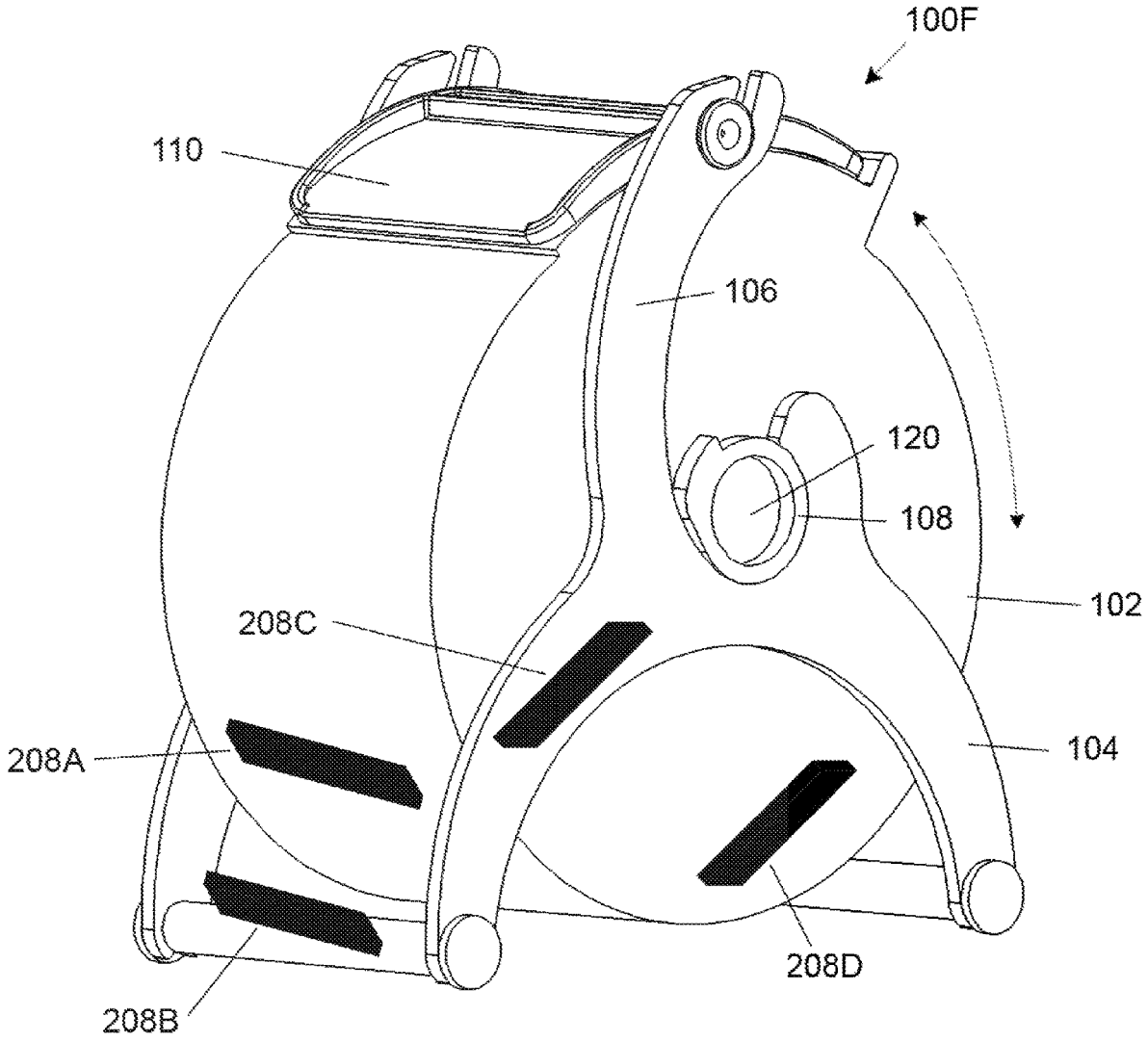
FIG. 2F is a schematic illustration of a perspective rear view of an exemplary self-closing dispenser comprising magnets to induce rotation of a container of the dispenser using magnetic induced torque, according to an exemplary embodiment of the present invention.

Reference is now made to FIG. 2F which is a schematic illustration of a perspective rear view of an exemplary self-closing dispenser comprising magnets to induce rotation of a container of the dispenser using magnetic induced torque, according to an exemplary embodiment of the present invention. An exemplary self-closing dispenser 100F such as the dispenser 100 presented in the closed state includes two or more magnetic elements. The one or more magnetic elements having attraction and/or repulsion relations may be coupled to the container 102 and the base 104 and/or the supporting arm(s) 106 in multiple different configurations. For example, a magnetic element 208A may be mechanically coupled to the container 120 away from the rotate axis 120 at the opposite direction from a dispensing opening such as the dispensing opening 112 and a magnetic element 208B may be mechanically coupled to the base 104.

The magnetic elements 208A and 208B are selected to have attraction relations between them such that when the magnetic elements 208A and 208B are pulled away from each other the magnetic induced torque tends to pull the magnetic elements 208A and 208B closer to each other. As another example, a pair of magnetic elements 208C and 208D which have repulsion relations between them may be applied to the dispenser 100F. The magnetic element 208C may be coupled to the container 102 next to the base 104 while the magnetic element 208D may be coupled to the base 104 such that in the open state, the two magnetic elements 208C and 208D are at the closest possible proximity. At the open state, the two magnetic elements 208C and 208D repel each other such that the magnetic induced torque tends to rotate the container 102 to the closed state. The magnetic elements such as, for example, the magnetic elements 208A and 208B may be selected to have a magnetic fields which are sufficient for bringing the container 102 (including the stored substance) to the closed state while not presenting difficulty for the user to rotate the container 102 to the open state.

In some exemplary embodiments, the dispenser 100 includes one or more motors which automatically rotate the container 102 to the closed state.

Figure 2G:
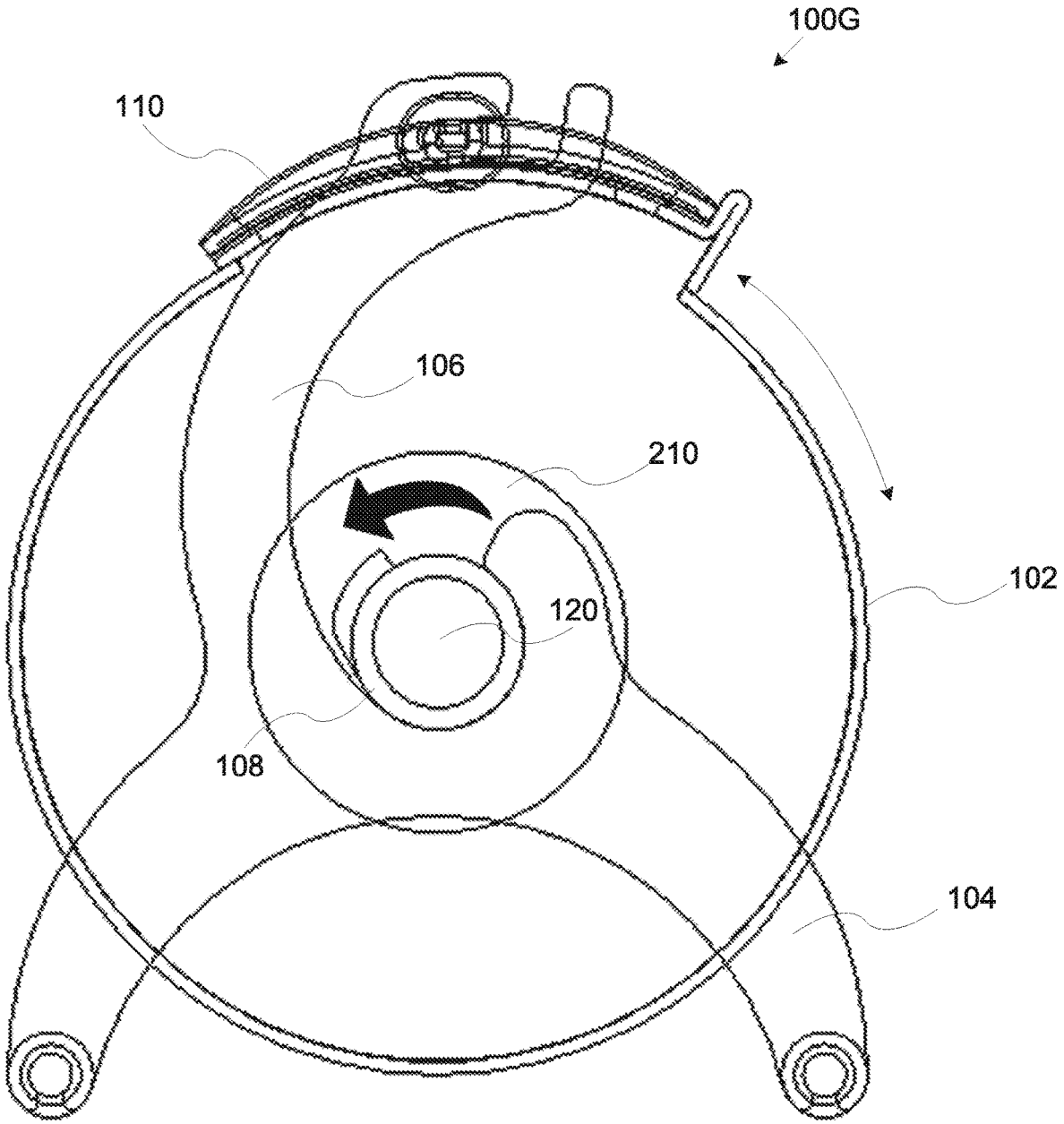
FIG. 2G is a schematic illustration of a side view of an exemplary self-closing dispenser comprising a motor to induce rotation of a container of the dispenser, according to an exemplary embodiment of the present invention.

Reference is now made to FIG. 2G which is a schematic illustration of a side view of an exemplary self-closing dispenser comprising a motor to induce rotation of a container of the dispenser, according to an exemplary embodiment of the present invention. An exemplary self-closing dispenser 100G such as the dispenser 100 presented in the closed state includes a one or more motors 210. The motor 210 may be integrated in the dispenser 100G in a plurality of designs, constructions and/or techniques. For example, the motor(s) 210 may be coupled to one or more of supporting arms such as the supporting arms 106 next to respective support members such as the support member 108 such that when in the open state, the container 102 is automatically rotated by the motor 210 back to the closed state.

Optionally, a sensor, for example, a proximity sensor, an accelerometer, and or/a gyroscope sensor may be further coupled to the dispenser 100G to detect the state in which the container 102 is located and to operate the motor(s) 210 accordingly. For example, while in the container 102 is in the closed state, the motor 210 is not operating, however when the container is in the open state, the motor 210 operates to rotate the container 102 back to the closed state. One or more additional sensors may further coupled to the dispenser 100 to identify a pressure applied to the container 102 to keep it in the open state. This may be useful to avoid operating the motor 210 while the user is trying to rotate the container 102 to the open state such that the motor 210 may be operated to rotate the container 102 to the closed state only after the user releases the container 102.

As discussed before, while the preferred embodiment is presented herein, it may not be consider as limiting as the dispenser 100 may utilize multiple other embodiments with respect to design, construction, dimensions, shapes and/or colors.

Figure 3A:
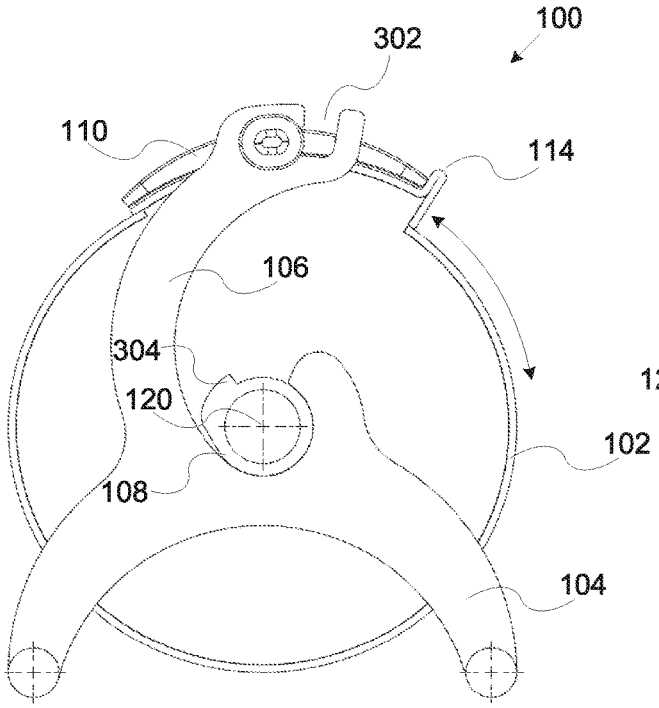
FIG. 3A is a schematic illustration of a side view of an exemplary self-closing dispenser, according to an exemplary embodiment of the present invention.
Figure 3B:
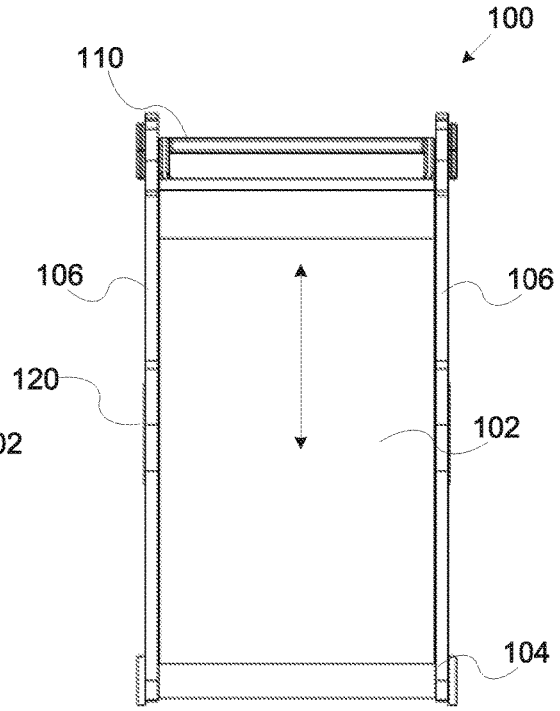
FIG. 3B is a schematic illustration of a front view of an exemplary self-closing dispenser, according to an exemplary embodiment of the present invention.
Figure 3C:
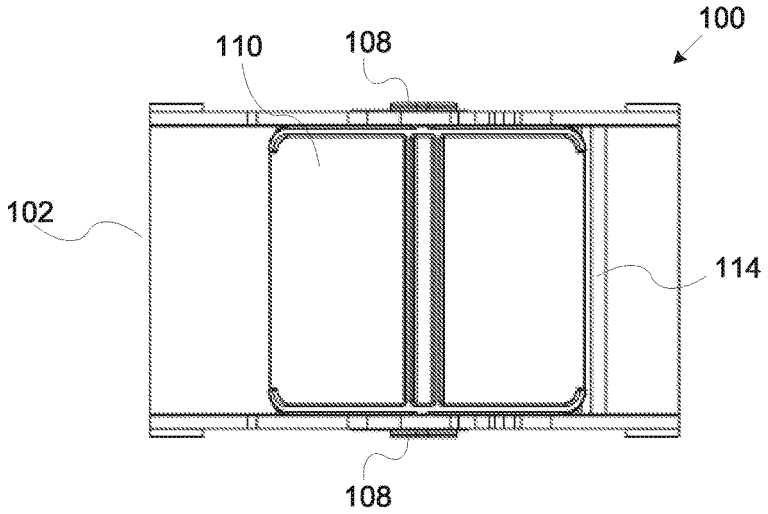
FIG. 3C is a schematic illustration of a top view of an exemplary self-closing dispenser, according to an exemplary embodiment of the present invention.

Reference is now made to FIG. 3A which is a schematic illustration of a side view of an exemplary self-closing dispenser, to FIG. 3B which is a schematic illustration of a side view of an exemplary self-closing dispenser and to FIG. 3C which is schematic illustration of a top view of an exemplary self-closing dispenser, according to an exemplary embodiment of the present invention. A dispenser such as the dispenser 100 includes one or more notches 302 which are formed in supporting arms such as the supporting arm(s) 106 to host a cover such as the cover 110. The notches 302 hold the cover 110 in place while providing the cover 110 with some degree of freedom to allow rotation of a container such as the container 102 from the open state to the closed state. The notches 302 may guide the cover 110 to properly fit over a dispensing opening such as the dispensing opening 112 of the container 102. The notches 302 may be further formed to allow detaching the cover 102 from the dispenser 100 for maintenance purposes, for example, filling the container 102 with the stored substance, cleaning the cover 110 and/or washing the cover 110. Support members such as the support members 108 may be constructed to include one or more stoppage elements such as the protrusion 304 which limit the rotational movement of the container 102 in the open state and/or in the closed state.

Figure 4A:
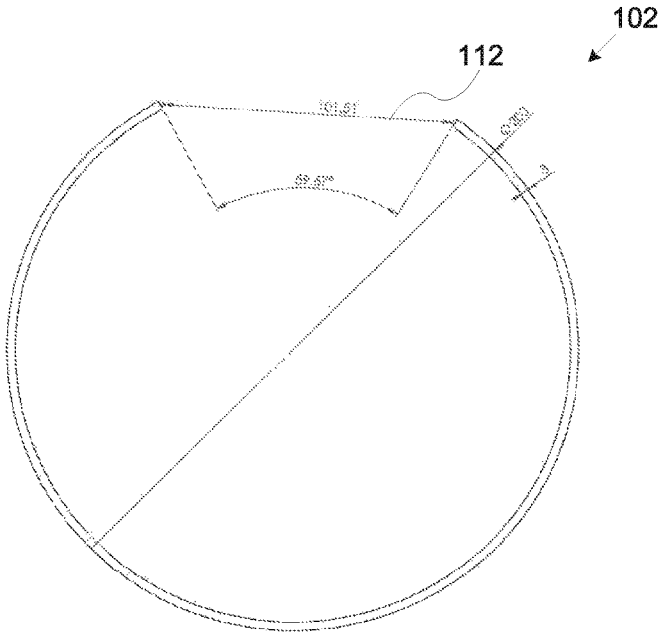
FIG. 4A is a schematic illustration of a side view of a container of an exemplary self-closing dispenser, according to an exemplary embodiment of the present invention.
Figure 4B:
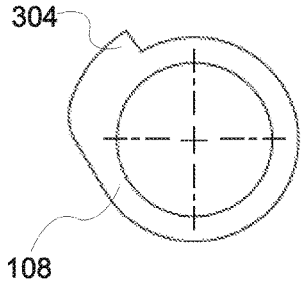
FIG. 4B is a schematic illustration of a side view of a mechanical support member of an exemplary self-closing dispenser, according to an exemplary embodiment of the present invention.
Figure 4C:
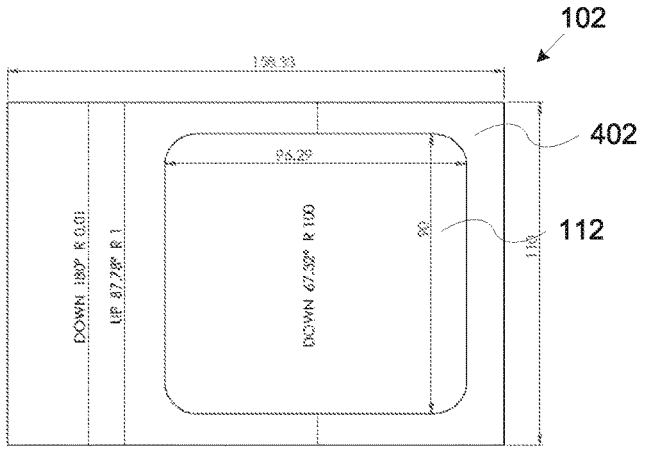
FIG. 4C is a schematic illustration of a top view of a container of an exemplary self-closing dispenser, according to an exemplary embodiment of the present invention.
Figure 4D:
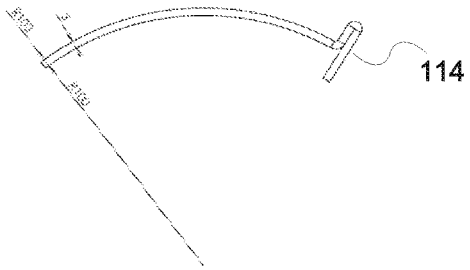
FIG. 4D is a schematic illustration of a side view of a handle of a container of an exemplary self-closing dispenser, according to an exemplary embodiment of the present invention.

Reference is now made to FIG. 4A which is a schematic illustration of a side view of a container of an exemplary self-closing dispenser, to FIG. 4B which is a schematic illustration of a side view of a mechanical support member of an exemplary self-closing dispenser, to FIG. 4C which is schematic illustration of a top view of a container of an exemplary self-closing dispenser and to FIG. 4D which is a schematic illustration of a side view of a handle of a container of an exemplary self-closing dispenser, according to an exemplary embodiment of the present invention. A container such as the container 102 includes a dispensing opening such as the dispensing opening 112. One or more support member such as the support member 108 may be mechanically coupled to the container 102. The two support members 108 may be coupled to the container 102 by means of mechanical connection, for example, screws and/or molded clips and/or rails molded in the support members 108 and/or the container 102 which lock the support members 108 in place on the container 102. Optionally, the support members 108 are integrated with the container 102 such that they constitute a single part produced using, for example, molding, 3D printing and/or CNC machining.

The support members 108 may be formed to include one or more stoppage elements such as the protrusion 304 which limit the rotational movement of the container 102 in the open state and/or in the closed state. A surrounding frame area 402 may be formed around the perimeter of the dispensing opening 112 to allow a cover such as the cover 110 to properly fit over the dispensing opening to allow for improved sealing characteristics of the dispenser 100. A handle such as the handle 114 may be mechanically coupled to the container 102 by means of mechanical connection, for example, screws and/or molded clips and/or rails molded in the handle 114 and/or the container 102 which lock the handle 114 in place on the container 102. Optionally, the handle 114 is integrated with the container 102 such that they constitute a single part produced using, for example, molding, 3D printing and/or CNC machining.

Figure 5A:
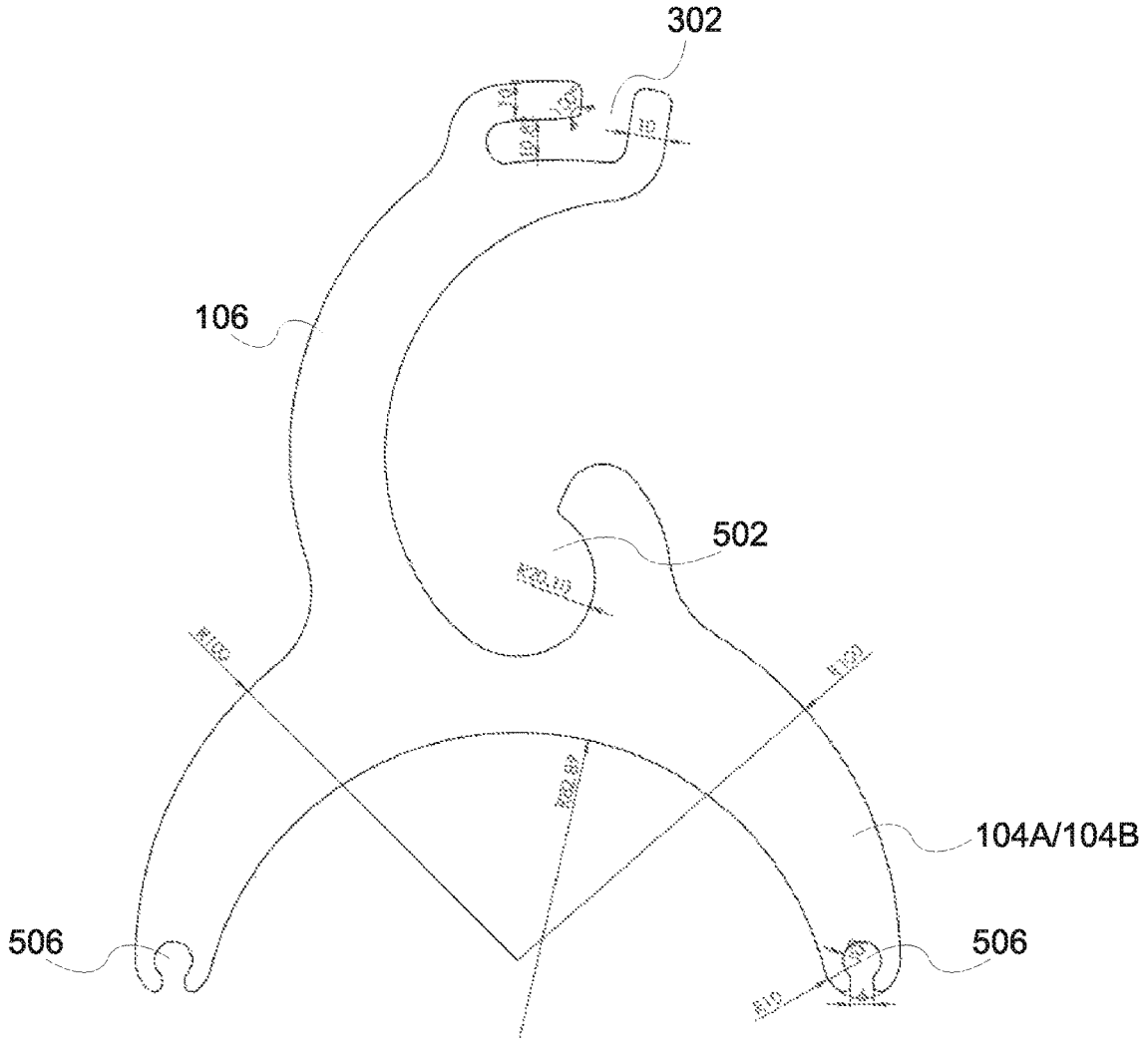
FIG. 5A is a schematic illustration of a side view of a base of an exemplary self-closing dispenser, according to an exemplary embodiment of the present invention.
Figure 5B:
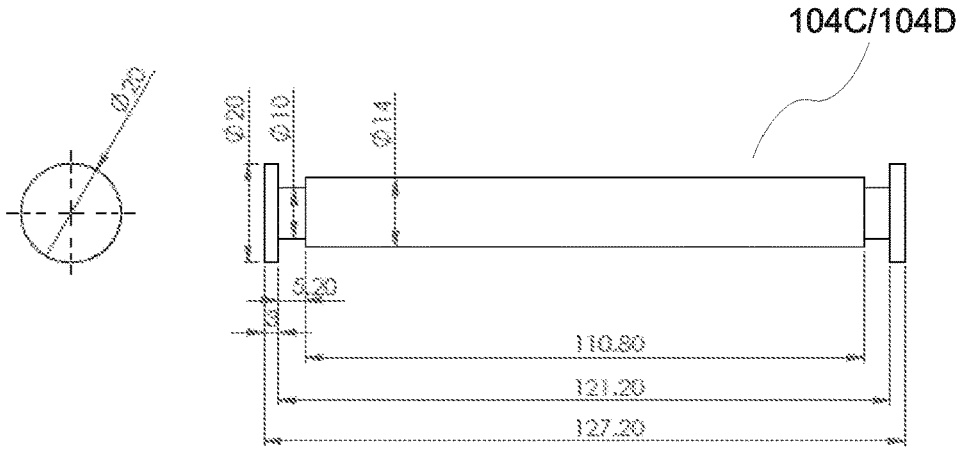
FIG. 5B is a schematic illustration of a side view of a joining part for a base of an exemplary self-closing dispenser, according to an exemplary embodiment of the present invention.

Reference is now made to FIG. 5A which is a schematic illustration of a side view of a base of an exemplary self-closing dispenser and to FIG. 5B which is a schematic illustration of a side view of a joining part for a base of an exemplary self-closing dispenser, according to an exemplary embodiment of the present invention.

A base such as the base 104 of a self-closing dispenser such as the dispenser 100 may have a supporting arm such as the supporting arm 106. The base 104 of the exemplary dispenser 100 is composed of two similar base parts such as the base part 104A and the base part 104B. The base parts 104A and 104B are assembled at the two sides of a container such as the container 102 such that support members such as the support members 108 are anchored to the base 104 and/or the support arm(s) 106 by one or more notches 502. Each of the supporting arms 106 of the base parts 104A and 104B may include a notch such as the notch 302 to host a cover such as the cover 110. The two base parts 104A and 104B may be joined together by one or more joining elements such a cylindrical joining element such as the joining elements 104C and/or 104D. The cylindrical joining element(s) 104C and/or 104D may be inserted in a respective notch 506 of each of the base parts 104A and 104B to connect the two base parts 104A and 104B together.

Figure 6A:
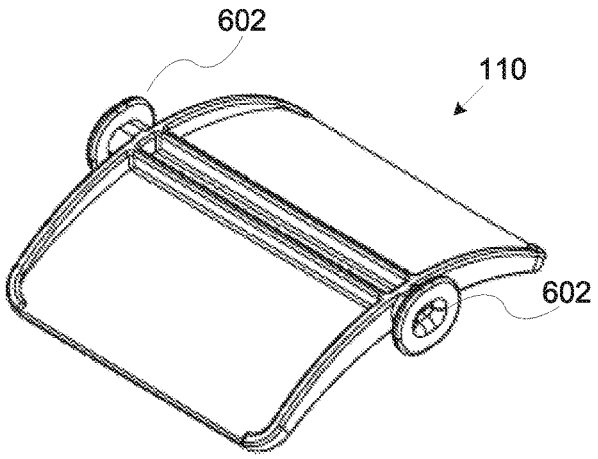
FIG. 6A is a schematic illustration of a perspective view of a cover of an exemplary self-closing dispenser, according to an exemplary embodiment of the present invention.
Figure 6B:
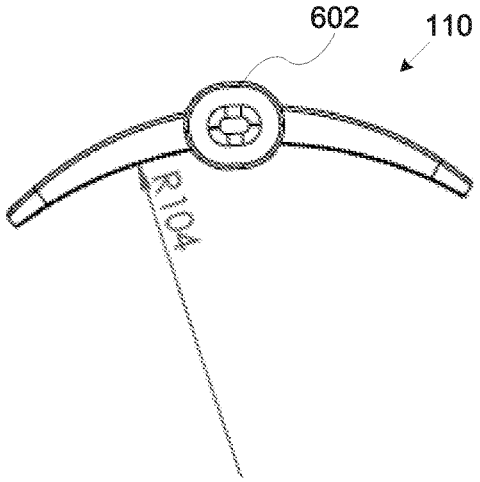
FIG. 6B is a schematic illustration of a side view of a cover of an exemplary self-closing dispenser, according to an exemplary embodiment of the present invention.
Figure 6C:
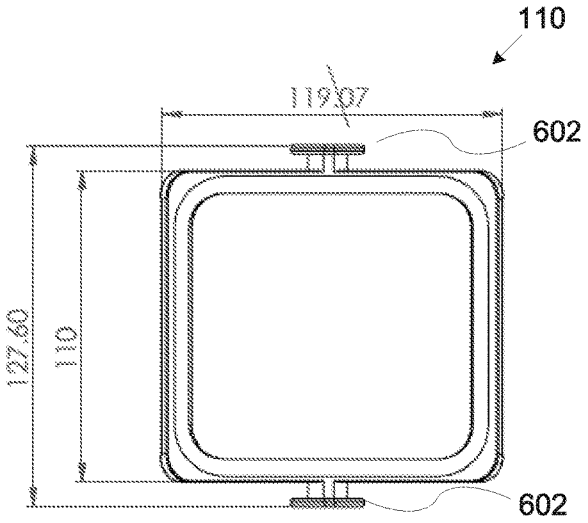
FIG. 6C is a schematic illustration of a top view of a cover of an exemplary self-closing dispenser, according to an exemplary embodiment of the present invention.
Figure 6D:
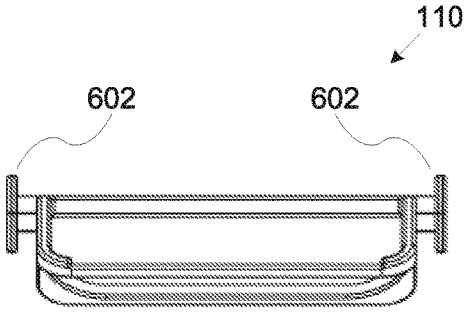
FIG. 6D is a schematic illustration of a front view of a cover of an exemplary self-closing dispenser, according to an exemplary embodiment of the present invention.

Reference is now made to FIG. 6A which is a schematic illustration of a perspective view of a cover of an exemplary self-closing dispenser, to FIG. 6B which is a schematic illustration of a side view of a cover of an exemplary self-closing dispenser, to FIG. 6C which is schematic illustration of a top view of a cover of an exemplary self-closing dispenser and to FIG. 6D which is a schematic illustration of a front view of a cover of an exemplary self-closing dispenser, according to an exemplary embodiment of the present invention. A cover such as the cover 110 of a self-closing dispenser such as the dispenser 100 may be formed in a curved shape to fit over a dispensing opening such as the dispensing opening 112 defined in a container such as the container 102. The cover 110 may be designed, constructed and/or formed to cover a surrounding frame area of the dispensing opening 112. The cover 110 may include one or more mechanical guiding elements 602 which may fit in hosting notches such as the notches 302 such that the cover 110 is loosely coupled to a base of the dispenser 100 such as the base 104.

In some exemplary embodiments the cover 110 is tightly coupled in the notches 302 formed in the supporting arm(s) 106 such that the cover 110 is substantially fixed in place within the notches 302.

Figure 7:
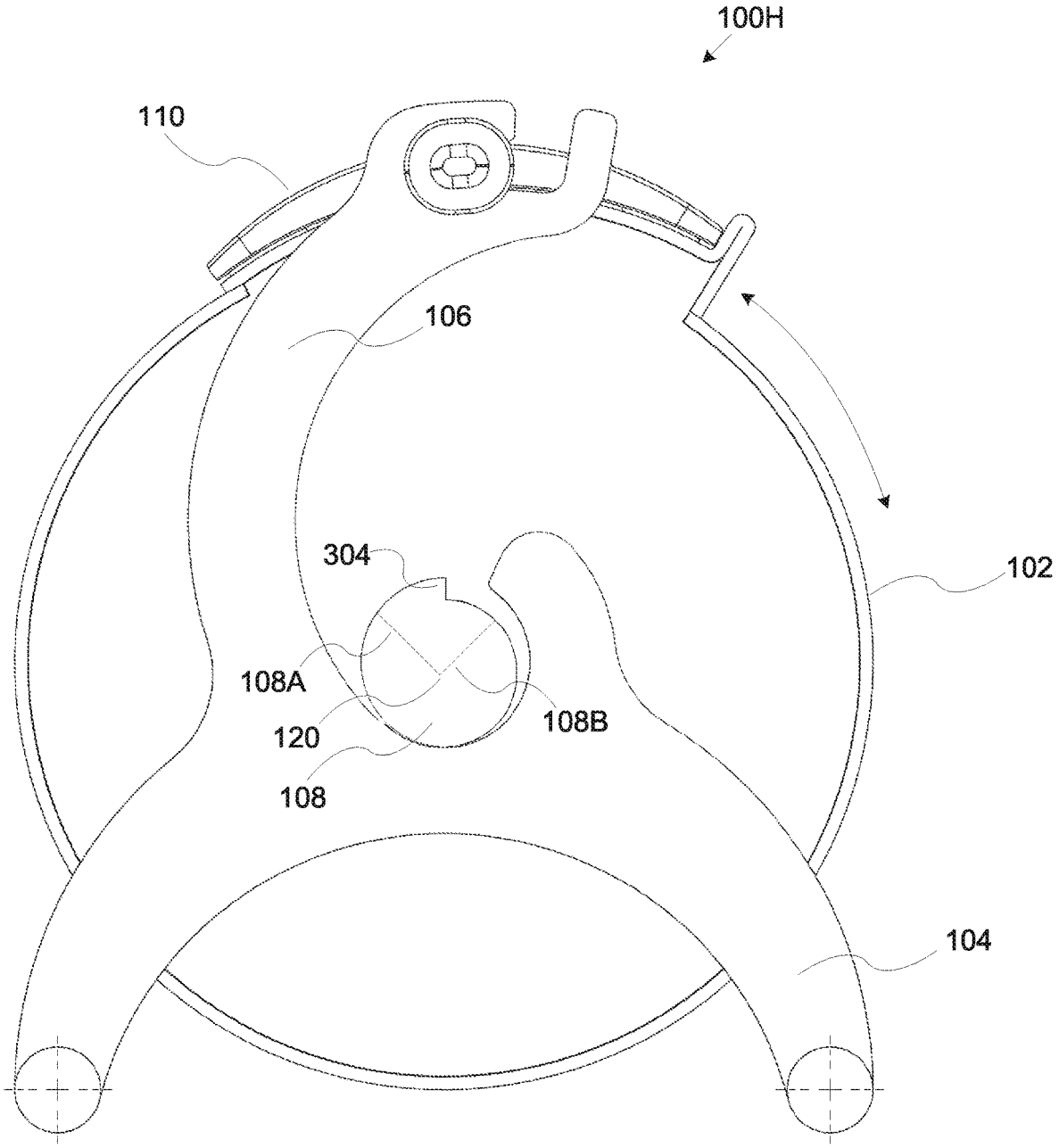
FIG. 7 is a schematic illustration of a side view of an exemplary self-closing dispenser with a fixed cover, according to an exemplary embodiment of the present invention.

Reference is now made FIG. 7 which is a schematic illustration of a side view of an exemplary self-closing dispenser with a fixed cover, according to an exemplary embodiment of the present invention. An exemplary self-closing dispenser 100H such as the dispenser 100 presented in the closed state includes a cover such as the cover 110 tightly coupled to one or more supporting arms such as the supporting arm 106 of a base such as the base 104. The cover 110 is tightly coupled to the supporting arms 106 such that the cover 110 is substantially fixed in place at one or more notches such as the notches 302. The cover 110 however may be detached by a user from the dispenser 100H for maintenance purposes. To allow a container such as the container 102 to rotate under the tightly coupled cover 110 around a rotation axis such as the rotation axis 120, the container 102 is mounted in the base 104 and/or the supporting arms 106 through specially designed and/or constructed support member(s) such as the support member 108. The support member(s) 108 are specially designed and/or constructed to have a varying radius such that a radius 108A of a first part of the support member 108 is larger than a radius 108B of a second part of the support members 108. The radios 108A is configured such that when rotated to the closed state a center of the support member 108 is lifted upwards with respect to one or more notches such as the notch 502 formed in the base 104 and/or the supporting arm(s) 106. As a result the container 102 is lifted upwards towards the cover 110 which may properly cover a dispensing opening such as the dispensing opening 112 defined in the circumferential wall of the container 102. The radius 108B is configured such that when the container 102 is rotated to the open state, the center of the support member 108 is lowered with respect to the notch(s) 502. As a result the container 102 is lowered, creating a gap between the container 102 and the cover 110 to allow the container 102 to rotate from the closed state to the open state without interference by the cover 110. Optionally, one or more stoppage elements such as the protrusion 304 may be formed in the support member to limit the rotation span of the container 102 around the rotation axis 120 in the closed state and/or the open state.

Figure 8:
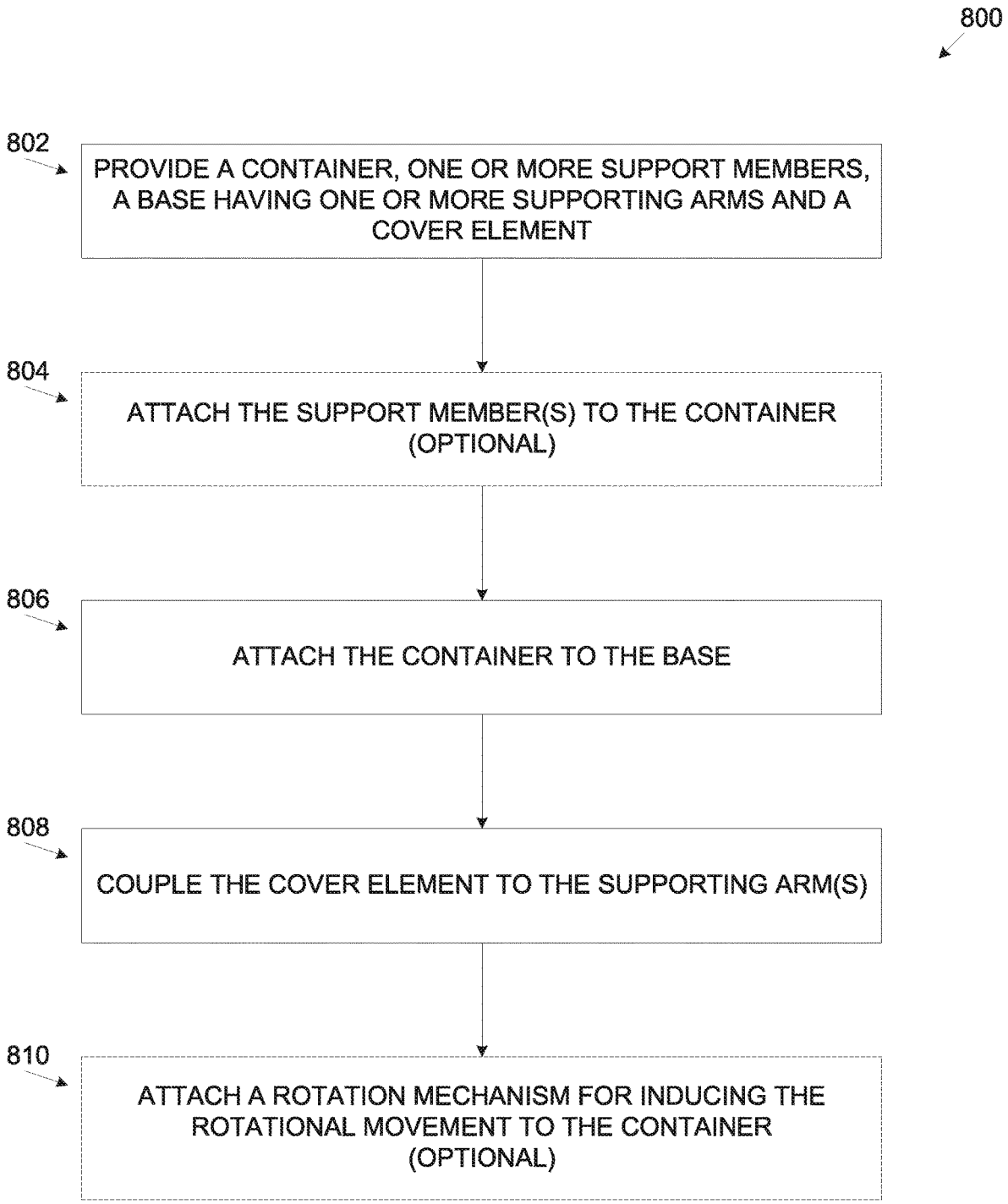
FIG. 8 is a flowchart of an exemplary process for composing an exemplary self-closing dispenser, according to an exemplary embodiment of the present invention.

Reference is now made to FIG. 8 which is a flowchart of an exemplary process for composing an exemplary self-closing dispenser, according to an exemplary embodiment of the present invention.

As shown at 802, a process 800 for composing and/or assembling a self-closing dispenser such as the dispenser 100 starts with providing the parts of the dispenser 100. The parts of the dispenser 100 may include, for example, a container such as the container 102, one or more support members such as the support member 108, a base such as the base 104, supporting arms such as the supporting arms 106 and a cover such as the cover 110. The dispenser 100 may further include one or more parts of a rotation mechanism for inducing a rotational movement for automatically rotating the container 102 to the closed state and/or holding the container 102 in the closed state during idle time.

As shown at 804, the support members 108 are coupled to the container 102. The step 804 is an optional step required only when the support member(s) 108 are not integrated with the container 102 as a single part. The support member(s) 108 may be coupled to the container 102 by means of mechanical connection such as, for example, screws and/or molded clips and/or rails molded in the support members 108 and/or the container 102 which lock the support members 108 in place on the container 102.

As shown at 806, the container 102 is mounted on the base 104 by anchoring the support member(s) 108 in the supporting arm(s) 106 at one or more mechanical connection points. Anchoring of the support member(s) 108 in the supporting arm(s) 106 and/or the base 104 may be done by placing the support member(s) 108 in notches such as the notches 502 formed in the base 104 and/or the support arm(s) 106. Optionally, in case the base 104 is composed of two or more parts such as the parts 104A, 104B, 104C and/or 104D, the base is fully assembled while attaching the container 102 to the base 104.

As shown at 808, the cover 110 is assembled on top the supporting arm(s) 106. Assembling the cover 110 on top the supporting arm(s) 106 may be done by coupling one or more guiding elements such as the guiding elements 602 to respective notches such as the notches 302 formed in the supporting arm(s) 106.

As shown at 810, the rotation mechanism is coupled to the dispenser 100. The step 810 is an optional step required only when the rotation mechanism is not mechanically integrated with one or more parts of the dispenser 100, for example, the container 102. This step is not required, for example, in case the rotation mechanism comprises a weight such as the weight 202 which is integrated with the container 102. This case may also not be necessary in case the dispenser 100 is designed such that the center of mass of the container 102 is not located at a rotation axis such as the rotation axis 120. For example, when the container 102 is elongated and/or otherwise constructed to have its center of mass shifted away from the rotation axis 120 in the opposite direction of a dispensing opening such as the dispensing opening 112.

The step 810 may be followed, for example, for the dispenser 100 such as the dispensers 100A, 100D, 100E, 100D and/or 100F which have a rotation mechanism, for example, a weight such as the weight 202, a spring such as the spring 204, an elastic band such as the elastic band 206, one or more magnetic elements such as the magnetic elements 208 and/or a motor such as the motor 210. The elements of the rotation mechanism may be properly attached to the respective parts of the dispenser 100, for example, the container 102, the base 104 and/or the supporting arm(s) 106. The parts of the rotation mechanism may be coupled to the respective parts of the dispenser 100 by means of mechanical connection such as, for example, screws and/or molded clips and/or rails molded in the rotation mechanism parts and/or the respective parts of the dispenser 100 which may lock the rotation mechanism parts in place.

Optionally, the rotation mechanism parts are placed in pre-formed locations constructed in respective parts of the dispenser 100. For example, the weight 202 may be placed in a compartment formed in the container 102. As another example, the magnetic elements, 208A, 208B. 208C and/or 208D may also be placed in one or more designated compartments and/or niches formed in the respective parts of the dispenser 100.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting. In addition, any priority document(s) of this application is/are hereby incorporated herein by reference in its/their entirety.

What is claimed is:

1. A dispensing device, comprising:

a container including a dispensing opening and a storage portion defined by at least one wall;

a base having at least one supporting arm;

at least one support member held by the at least one supporting arm for supporting a rotation of said container from a closed state to an open state and vice versa, said rotation is held around a rotation axis defined by a location of said at least one support member;

a cover element coupled to said at least one supporting arm to allow uncovering said dispensing opening when said container rotates around said rotation axis; and wherein said cover element covers said dispensing opening when said container is rotated into said closed state and does not cover at least a portion of said dispensing opening when the container is rotated into said open state;

wherein a center of mass of said container is located away from said rotation axis such that the weight of the container itself induces said rotation of said container from said open state to said closed state.

2. The dispensing device of claim 1, further comprising said at least one support member is integrated in said container.

3. The dispensing device of claim 1, wherein said container includes a handle located at the bottom of said dispensing opening to allow a user to rotate said container.

4. The dispensing device of claim 1, further comprising a weight element integrated to said container at an offset from said rotation axis so as to further induce said rotation of said container from said open state to said closed state by Gravity-induced torque.

5. The dispensing device of claim 1, further comprising said container is elongated away from said rotation axis to shift the center of mass of said container away from said rotation axis so as to induce said rotation of said container from said open state to said closed state by Gravity-induced torque.

6. The dispensing device of claim 1, further comprising a spring element that further induces said rotation of said container from said open state to said closed state by spring-induced torque.

7. The dispensing device of claim 1, further comprising an elastic band element that further induces said rotation of said container from said open state to said closed state by elasticity-induced torque.

8. The dispensing device of claim 1, further comprising a first magnet that maintains a magnetic relation with a second magnet element so as to further induce said rotation of said container from said open state to said closed state by magnet-induced torque;

wherein said magnetic relation includes at least one of: attraction and repulsion.

9. The dispensing device of claim 1, further comprising a motor that further induces said rotation of said container from said open state to said closed state by operation of said motor.

10. The dispensing device of claim 1, further comprising said at least one support member includes a stoppage element which is barred by said at least one supporting arm at a rotation span limit of said rotation.

11. The dispensing device of claim 1, wherein the cover element is supported in a plurality of notches each formed in one of said at least one supporting arm;

wherein said cover element is pushed in said plurality of notches toward said container by a force induced by said rotation of said container from said open state to said closed state.

12. The dispensing device of claim 1, further comprising said container having a frame area outlining said dispensing opening such that said cover element overlaps with said frame area in said closed state.

13. The dispensing device of claim 1, further comprising said cover element includes an elastic element which makes contact with said container around said dispensing opening in said closed state.

14. The dispensing device of claim 1, wherein said at least one wall comprises at least two lateral walls.

15. The dispensing device of claim 1, wherein said at least one wall comprises a transparent circumferential wall and at least two transparent lateral walls.

16. The dispensing device of claim 1, further comprising said container being detachable from said at least one supporting arm.

17. The dispensing device of claim 1, wherein said cover element is detachable from said at least one supporting arm.

18. A method of composing a dispensing device, comprising:

providing a container which includes a storage portion defined by at least one wall having a dispensing opening defined thereon, a base having at least one supporting arm, at least one support member, and a cover element;

placing said at least one support member on said at least one supporting arm for supporting a rotation of said container from a closed state to an open state and vice versa, said rotation is held around a rotation axis which is offset from a center of mass of said container and is defined by a location of said at least one support member such that said rotation of said container from said open state to said closed state results from Gravity-induced torque induced by said the weight of the container itself; and placing said cover element to remain fixed in relation to the at least one supporting arm while said container rotates around said rotation axis such that said cover element covers said dispensing opening when said container is rotated into said closed state and does not cover said dispensing opening when said container is rotated into said open state.

* * * * *